US010372065B2

(12) United States Patent
Eto

(10) Patent No.: US 10,372,065 B2
(45) Date of Patent: Aug. 6, 2019

(54) IMAGE FORMING APPARATUS

(71) Applicant: CANON KABUSHIKI KAISHA, Tokyo (JP)

(72) Inventor: Masakazu Eto, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/020,211

(22) Filed: Jun. 27, 2018

(65) Prior Publication Data

US 2019/0004453 A1 Jan. 3, 2019

(30) Foreign Application Priority Data

Jun. 30, 2017 (JP) ..... 2017-129625

(51) Int. Cl.
*G03G 15/16* (2006.01)
*G03G 15/08* (2006.01)

(52) U.S. Cl.
CPC ..... *G03G 15/161* (2013.01); *G03G 15/0865* (2013.01)

(58) Field of Classification Search
CPC ..... G03G 15/161; G03G 15/0865
See application file for complete search history.

(56) References Cited

U.S. PATENT DOCUMENTS 9,075,352 B2 * 7/2015 Seki ..... G03G 21/0041
9,229,409 B2 * 1/2016 Imazeki ..... G03G 15/556
9,869,957 B2 * 1/2018 Nameki ..... G03G 15/5054

FOREIGN PATENT DOCUMENTS

JP 2007-079126 A 3/2007
JP 2009-282487 A 12/2009
JP 2013-101169 A 5/2013

* cited by examiner

*Primary Examiner* — Gregory H Curran
(74) *Attorney, Agent, or Firm* — Venable LLP

(57) ABSTRACT

An image forming apparatus includes a movable photosensitive member, a toner image forming portion, a movable intermediary transfer member, an image transfer portion, a cleaning blade, a job executing portion, a toner supply executing portion capable of executing a supplying operation for supplying the toner to a contact portion in a non-image-forming period, a storing portion configured to store a first integrated value obtained by integrating a value corresponding to a distance of movement of the intermediary transfer member and a second integrated value obtained by integrating a number of images formed in the job, and a controller configured to cause the toner supply executing portion to execute the supplying operation and configured to set the first and second integrated values at initial values when the first integrated value reaches a first threshold or when the second integrated value reaches a second threshold, during execution of the job.

17 Claims, 15 Drawing Sheets

IMAGE FORMING APPARATUS

FIELD OF THE INVENTION AND RELATED ART

The present invention relates to an image forming apparatus, such as a copying machine, a facsimile machine or a printer, of an electrophotographic type, or an electrostatic recording type.

In the image forming apparatus of the electrophotographic type or the like, a deposited matter such as toner (transfer residual toner) or paper powder on an image bearing member such as a photosensitive member (electrophotographic photosensitive member) has been removed by a cleaning means. As the cleaning means, a cleaning blade which is a cleaning member contacting the image bearing member has been widely used.

In an image forming apparatus using the cleaning blade, for example, in the case where formation of an image with a low image ratio is continued, a frictional force between the image bearing member and the cleaning blade increases in some instances. Then, when the frictional force is excessively large, abnormal vibration (shuddering) of the cleaning blade occurs and the toner slips through the cleaning blade, so that improper cleaning occurs in some instances. Further, when the frictional force is excessively large, the increased frictional force causes turning-up of the cleaning blade (i.e., a phenomenon that a free end portion of the cleaning blade is turned up along a surface movement direction of the image bearing member) and further causes abrasion and breakage of the cleaning blade.

Therefore, a method in which an operation for supplying the toner to a contact portion between the image bearing member and the cleaning blade (herein, referred to as a "supplying operation") has been known. By carrying out the supplying operation, a lubricant (principally, an external additive of the toner) is supplied between the image bearing member and the cleaning blade, so that a sliding property therebetween can be maintained. The supplying operation is carried out in general on the basis of a cumulative image formation number (cumulative number of toner images of image formation) in the case where the cumulative image formation number reaches a predetermined threshold. This is because a degree of a decrease of the lubricant between the image bearing member and the cleaning blade relates to a traveling distance of the image bearing member and thus roughly has a correlation with the image formation number. However, a relationship between the image formation number and the traveling distance of the image bearing member varies depending on the image formation number designated in a single job, for example. For that reason, when the supplying operation is executed on the basis of the cumulative image formation number, at an unnecessary point of toner image, the supplying operation is executed, so that a lowering in lifetime of members, such as the image bearing member and the cleaning blade, due to unnecessary toner consumption and unnecessary idling of the image bearing member occurs in some cases.

On the other hand, on the basis of the traveling distance of the image bearing member, the supplying operation is carried out in the case where the traveling distance reaches a predetermined threshold, so that the supplying operation can be executed efficiently.

In another aspect, in the image forming apparatus using the cleaning blade, paper powder deposits in the neighborhood of the contact portion between the image bearing member and the cleaning blade, and a part thereof is sandwiched (nipped) between the image bearing member and the cleaning blade in some cases. Incidentally, specifically, the paper powder deposits in a space, between a free end surface of the cleaning blade and a surface of the image bearing member, on a side upstream of an edge portion of a free end portion of the cleaning blade with respect to the surface movement direction of the image bearing member. Further, when the paper powder is sandwiched between the image bearing member and the cleaning blade, the toner slips through the cleaning blade with that (sandwiched) portion as a starting point, so that the improper cleaning occurs in some cases. Particularly, in the case where paper (recycled paper or the like) larger in generation amount and deposition amount of the paper powder than normal paper is used as a recording material, the paper powder is liable to deposit, so that the improper cleaning is liable to occur.

Therefore, a method in which in a non-image-forming period, the image bearing member is rotated (reverse rotation) in an opposite direction to a rotational (normal rotation) direction in an image forming period and thus deposited paper powder is removed has been known (Japanese Laid-Open Patent Application (JP-A) 2007-79126). However, in this method, for example, in the case where the reverse rotation of the image bearing member is carried out in a sheet interval during continuous image formation, productivity of the image formation lowers in some instances.

On the other hand, in JP-A 2007-79126, a method in which before the paper powder deposits, the toner is supplied to the contact portion between the image bearing member and the cleaning blade and thus deposition itself of the paper powder is suppressed by forming a barrier with the toner in the neighborhood of the contact portion has been known.

Incidentally, specifically, the barrier with the toner is formed in a space, between a free end surface of the cleaning blade and a surface of the image bearing member, on a side upstream of an edge portion of a free end portion of the cleaning blade with respect to a surface movement direction of the image bearing member.

SUMMARY OF THE INVENTION

The toner supplied to the contact portion between the image bearing member and the cleaning blade by the above-described supplying operation carried out for maintaining the sliding property can also perform a function of suppressing deposition of the paper powder by forming the above-described barrier with the toner. For that reason, the toner supplied for maintaining the sliding property can be also used as the toner for forming the barrier with the toner.

Here, as described above, the supplying operation for maintaining the sliding property may desirably be carried out at predetermined timing on the basis of the traveling distance of the image bearing member. This is because an increase in frictional force between the image bearing member and the cleaning blade relates to a degree of a decrease in amount of the lubricant between the image bearing member and the cleaning blade due to traveling (movement) of the image bearing member. Also a degree that the improper cleaning resulting from deposition of the paper powder is liable to occur relates to a degree of a decrease in frictional force and barrier with the toner between the image bearing member and the cleaning blade, and therefore, roughly has a correlation with the traveling distance of the image bearing member. On the other hand, the degree that the improper cleaning resulting from the deposition of the paper powder is liable to occur correlates with the image formation number, particularly, an image formation number designated in a single job (i.e., continuous image formation number). This is because during the continuous image formation, the paper powder from the paper used as the recording material is continuously sent to a cleaning position. Further, when the supplying operation is executed at predetermined timing on the basis of the traveling distance of the image bearing member, it turned out that the supplying operation cannot be executed at timing necessary to suppress the improper cleaning resulting from the deposition of the paper powder.

According to an aspect of the present invention, there is provided an image forming apparatus comprising: a movable photosensitive member; a toner image forming portion configured to form a toner image by depositing toner on an electrostatic image formed on the photosensitive member; a movable intermediary transfer member having an endless shape; an image forming portion configured to primary-transfer the toner image from the photosensitive member onto the intermediary transfer member and then to secondary-transfer the toner image from the intermediary transfer member onto a recording material; a cleaning blade contacting the intermediary transfer member at a contact portion, and configured to remove a deposited matter on the intermediary transfer member with movement of the intermediary transfer member; a job executing portion capable of executing a job which is started by a single start instruction and which is a series of operations in which images are formed and outputted on a single or a plurality of recording materials; a toner supply executing portion capable of executing a supplying operation for supplying the toner to the contact portion by forming a supplying toner image on the photosensitive member and then by primary-transferring the supplying toner image from the photosensitive member onto the intermediary transfer member in a non-image-forming period which is other than a period in which the toner image to be secondary-transferred onto the recording material is formed on the photosensitive member; a storing portion configured to store a first integrated value obtained by integrating a value corresponding to a distance of movement of the intermediary transfer member and a second integrated value obtained by integrating a number of images formed in the job or jobs; and a controller configured to cause the toner supply executing portion to execute the supplying operation and configured to set the first and second integrated values at initial values when the first integrated value reaches a first threshold or when the second integrated value reaches a second threshold, during execution of the job.

According to another aspect of the present invention, there is provided an image forming apparatus comprising: a movable photosensitive member; a toner image forming portion configured to form a toner image by depositing toner on an electrostatic image formed on the photosensitive member; a cleaning blade contacting the photosensitive member at a first portion and configured to remove a deposited matter on the photosensitive member with movement of the photosensitive member; a movable intermediary transfer member; an image forming portion configured to primary-transfer the toner image from the photosensitive member onto the intermediary transfer member and then to secondary-transfer the toner image from the intermediary transfer member onto a recording material; a cleaning blade contacting the intermediary transfer member at a second contact portion, and configured to remove a deposited matter on the intermediary transfer member with movement of the intermediary transfer member; a job executing portion capable of executing a job which is started by a single start instruction and which is a series of operations in which images are formed and outputted on a single or a plurality of recording materials; a toner supply executing portion capable of executing a supplying operation for supplying the toner to the first and second contact portions by forming a supplying toner image on the photosensitive member and then by primary-transferring the supplying toner image from the photosensitive member onto the intermediary transfer member in a non-image-forming period which is other than a period in which the toner image to be secondary-transferred onto the recording material is formed on the photosensitive member; a storing portion configured to store a first integrated value obtained by integrating a value corresponding to a distance of the movement of the photosensitive member and a second integrated value obtained by integrating a number of images formed in the job or jobs; and a controller configured to cause the toner supply executing portion to execute the supplying operation and configured to set the first and second integrated values at initial values when the first integrated value reaches a first threshold or when the second integrated value reaches a second threshold, during execution of the job.

Further features of the present invention will become apparent from the following description of exemplary embodiments with reference to the attached drawings.

Figure 6:
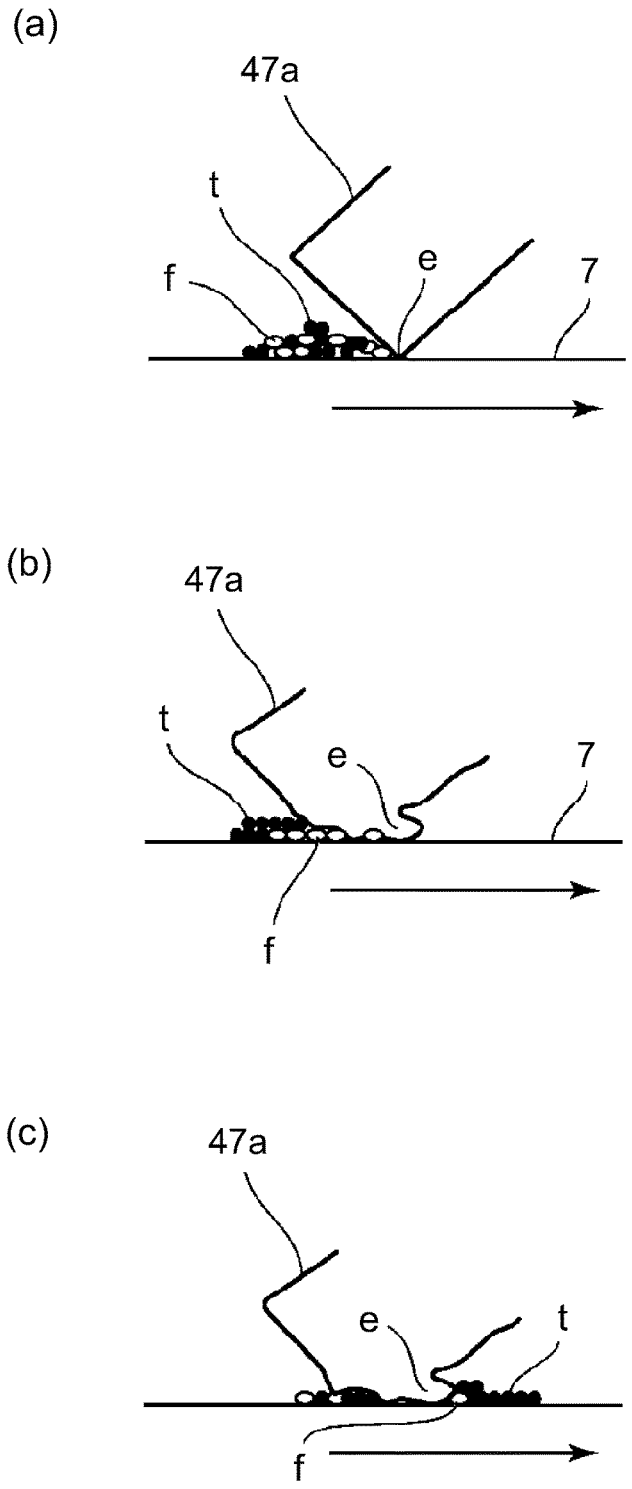

Parts (a) to (c) of FIG. 6 are schematic views for illustrating improper cleaning due to deposition of paper powder.

Figure 7:
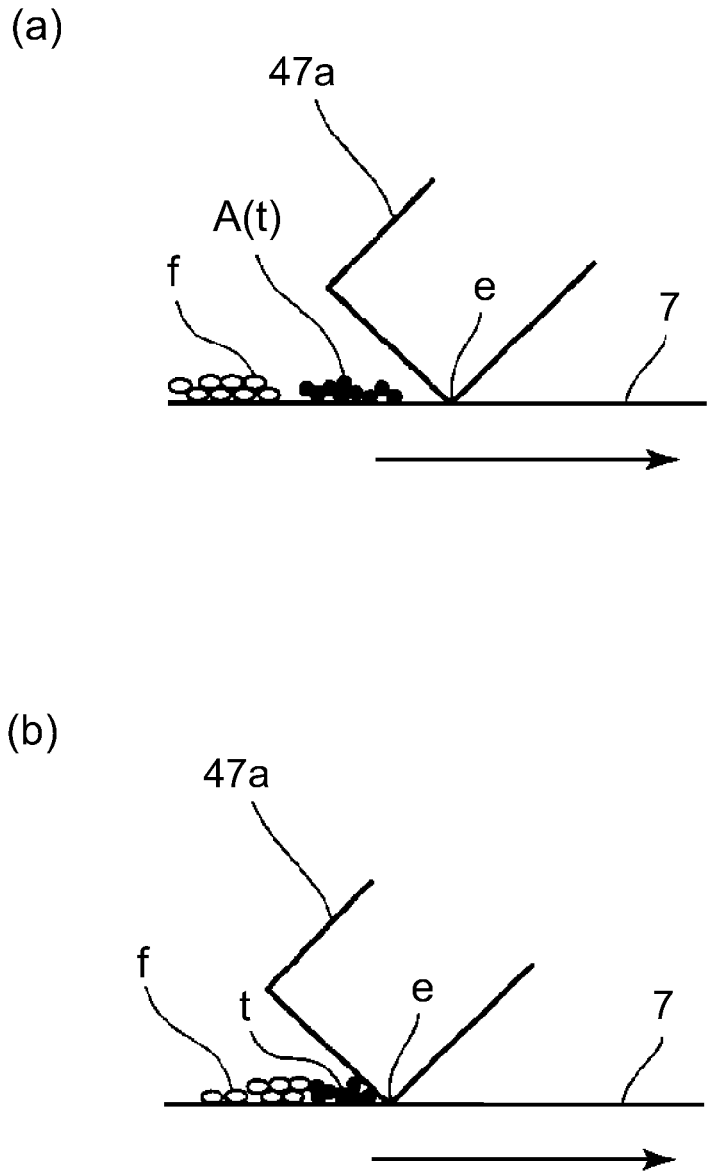

Parts (a) and (b) of FIG. 7 are schematic views for illustrating a suppressing mechanism of the deposition of the paper powder.

Figure 8:
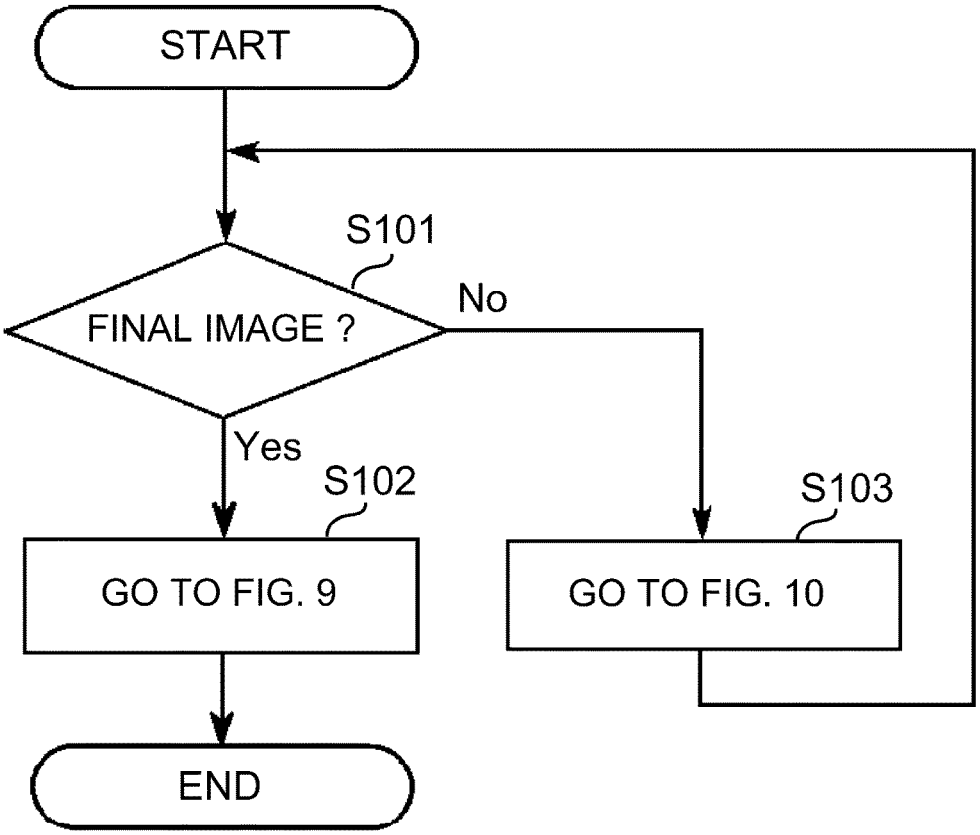

FIG. 8 is a flowchart of a control switching procedure between a post-rotation step and a sheet interval step.

Figure 9:
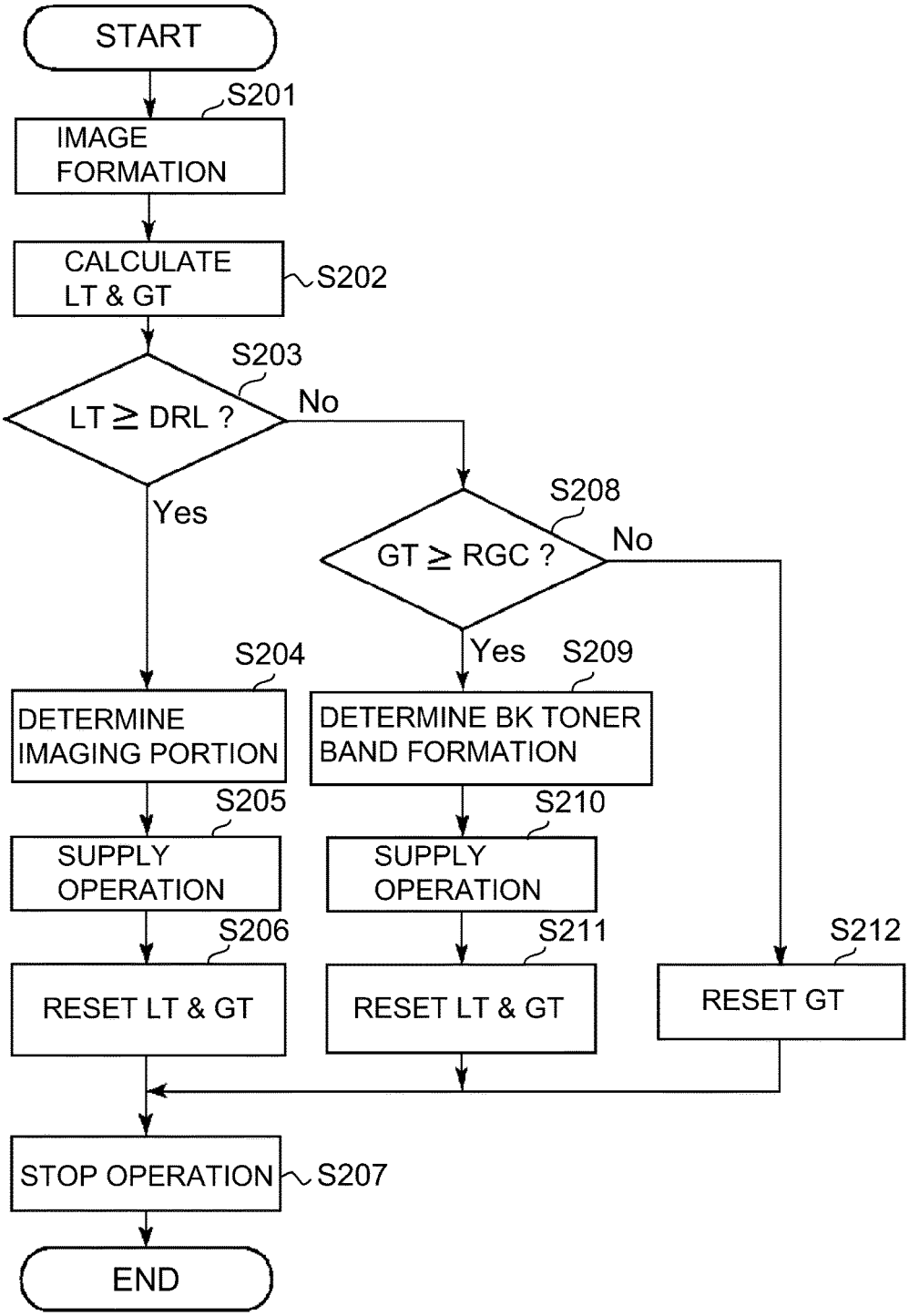

FIG. 9 is a flowchart of a procedure for executing the supplying operation in the post-rotation step.

Figure 10:
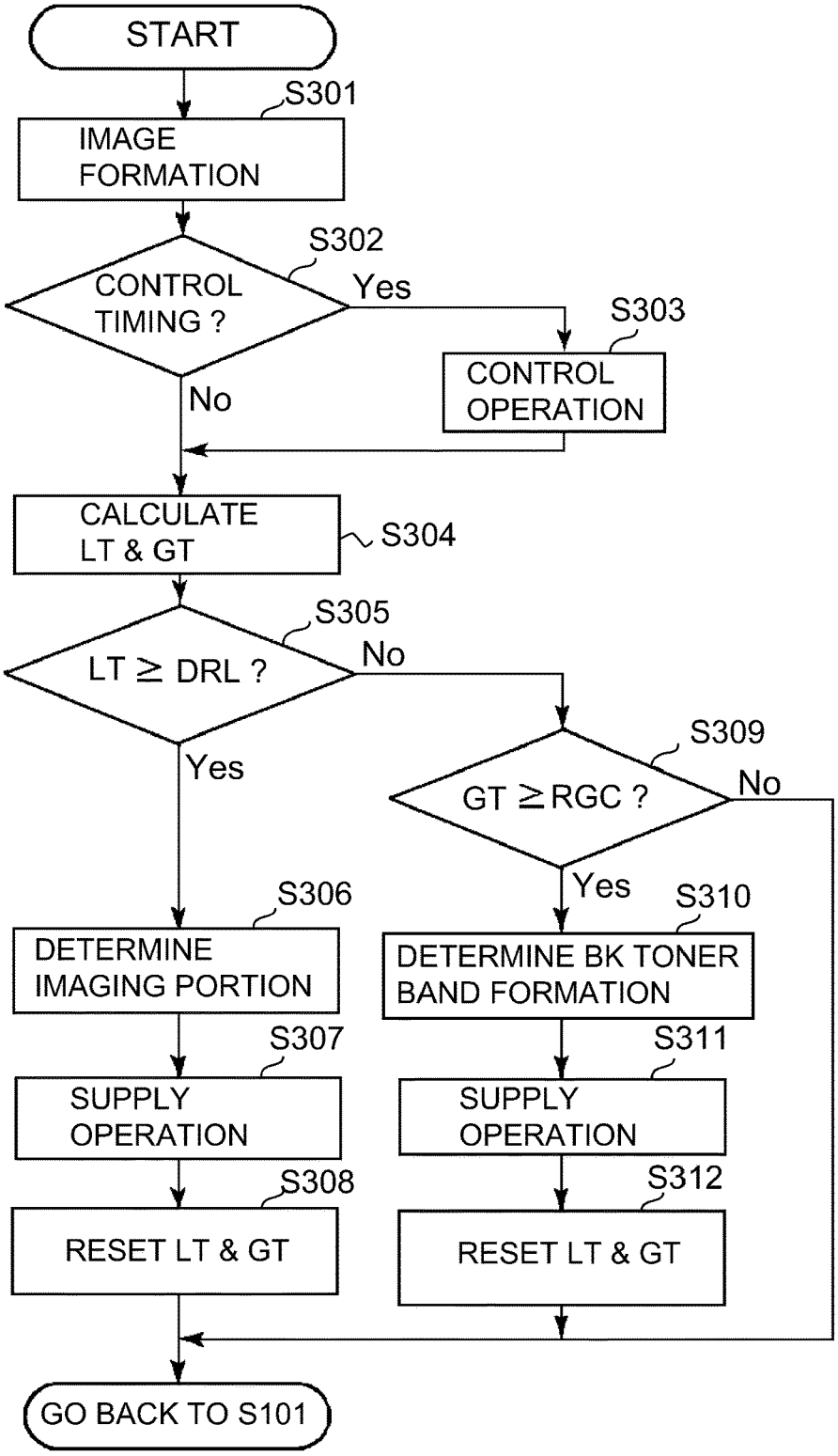

FIG. 10 is a flowchart of a procedure for executing the supplying operation in the sheet interval step.

Figure 11:
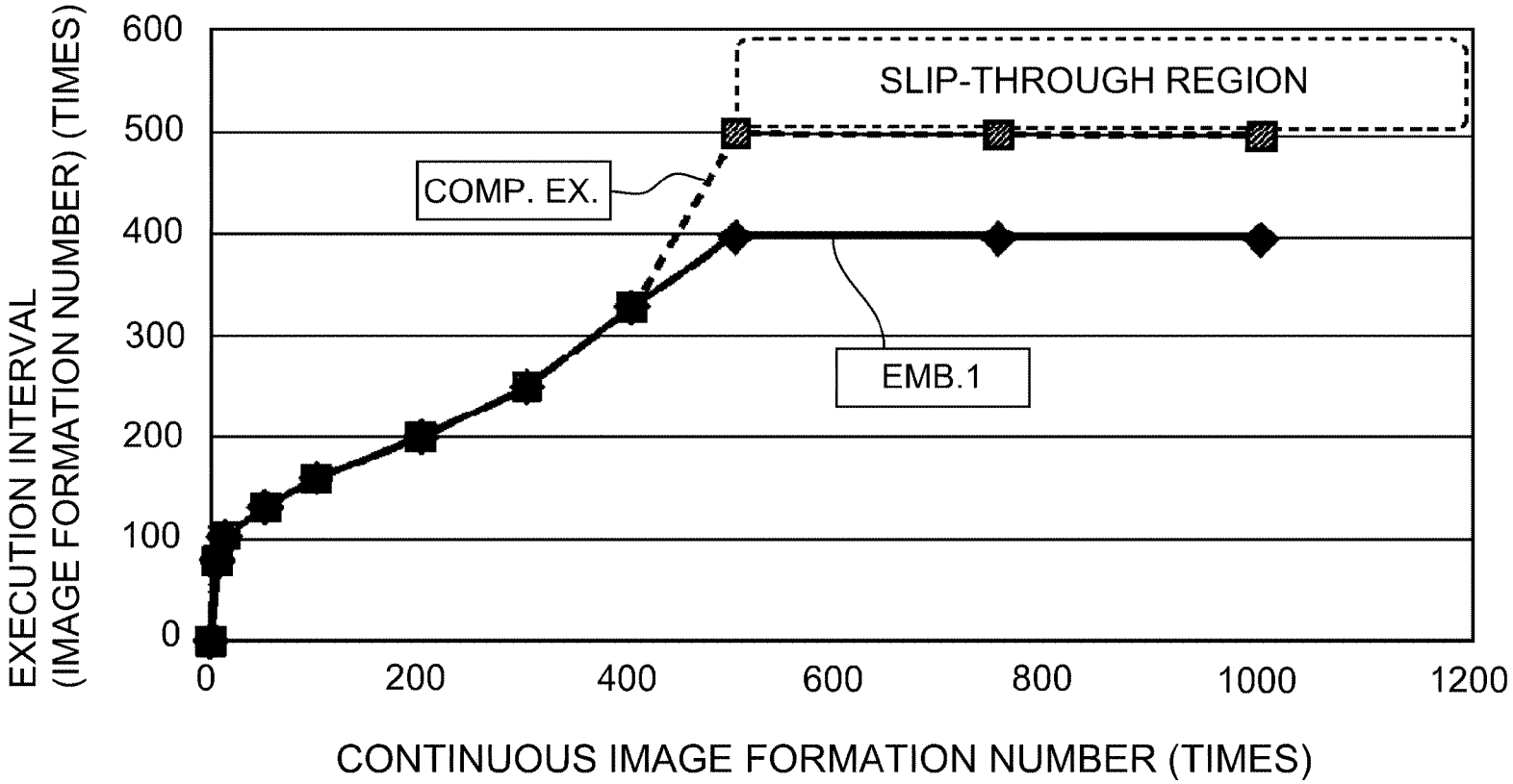

FIG. 11 is a graph for illustrating an execution interval of a supplying operation in Embodiment 1 and a comparison example.

Figure 12:
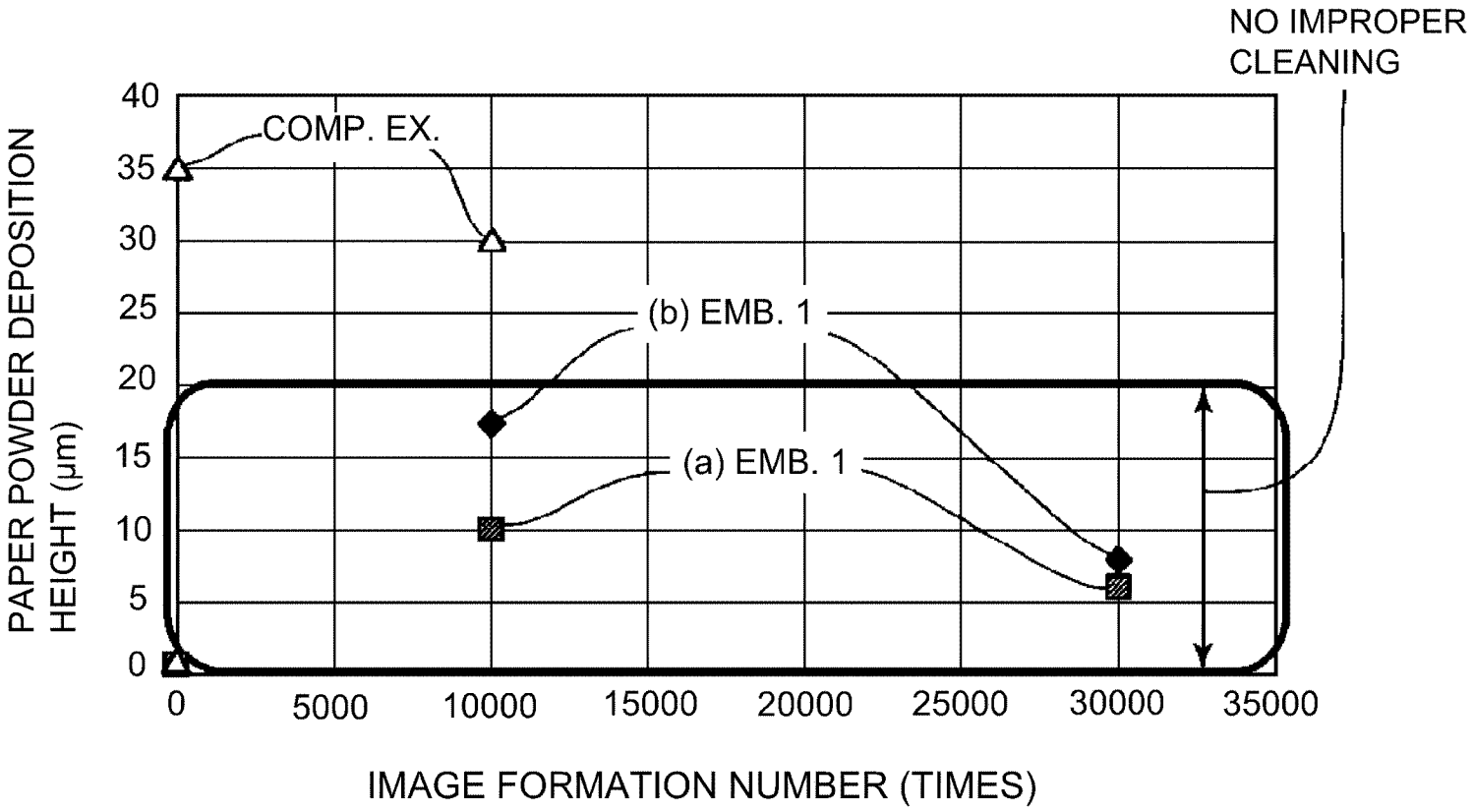

FIG. 12 is a graph showing a deposition amount of paper powder in Embodiment 1 and the comparison example.

Figure 13:
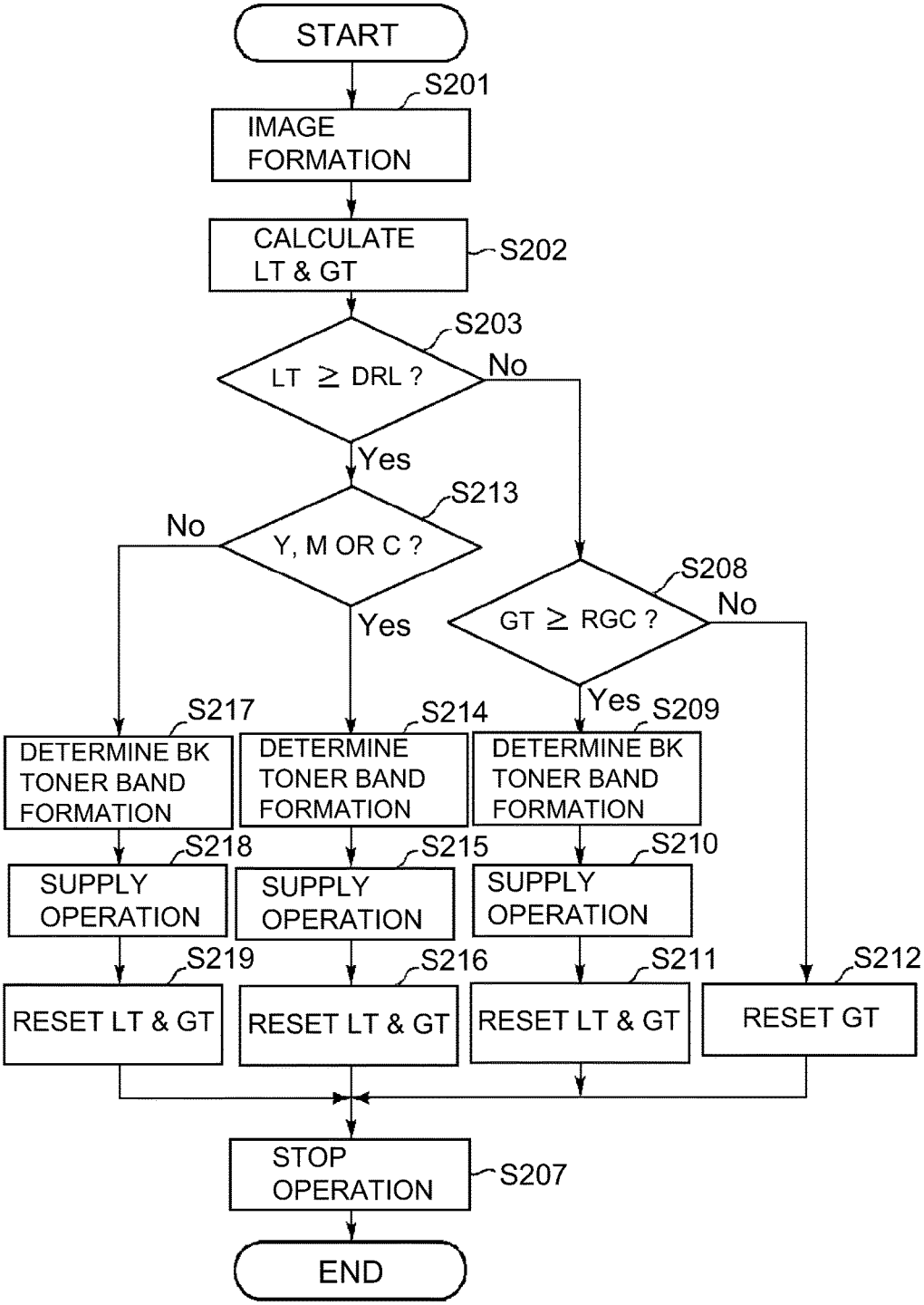

FIG. 13 is a flowchart of a procedure for executing a supplying operation in a post-rotation step in Embodiment 2.

Figure 14:
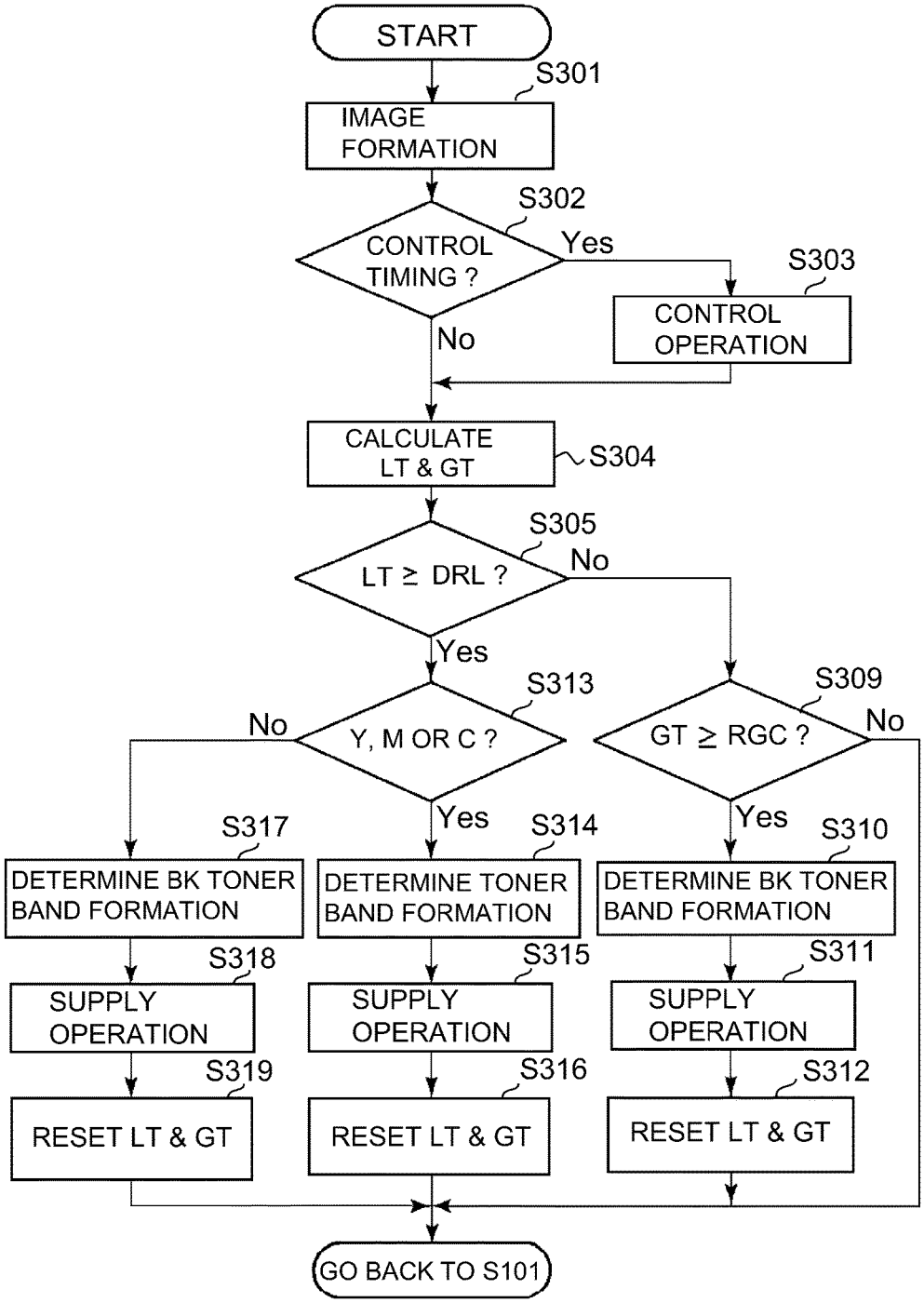

FIG. 14 is a flowchart of a procedure for executing a supplying operation in a sheet interval step in Embodiment 2.

Figure 15:
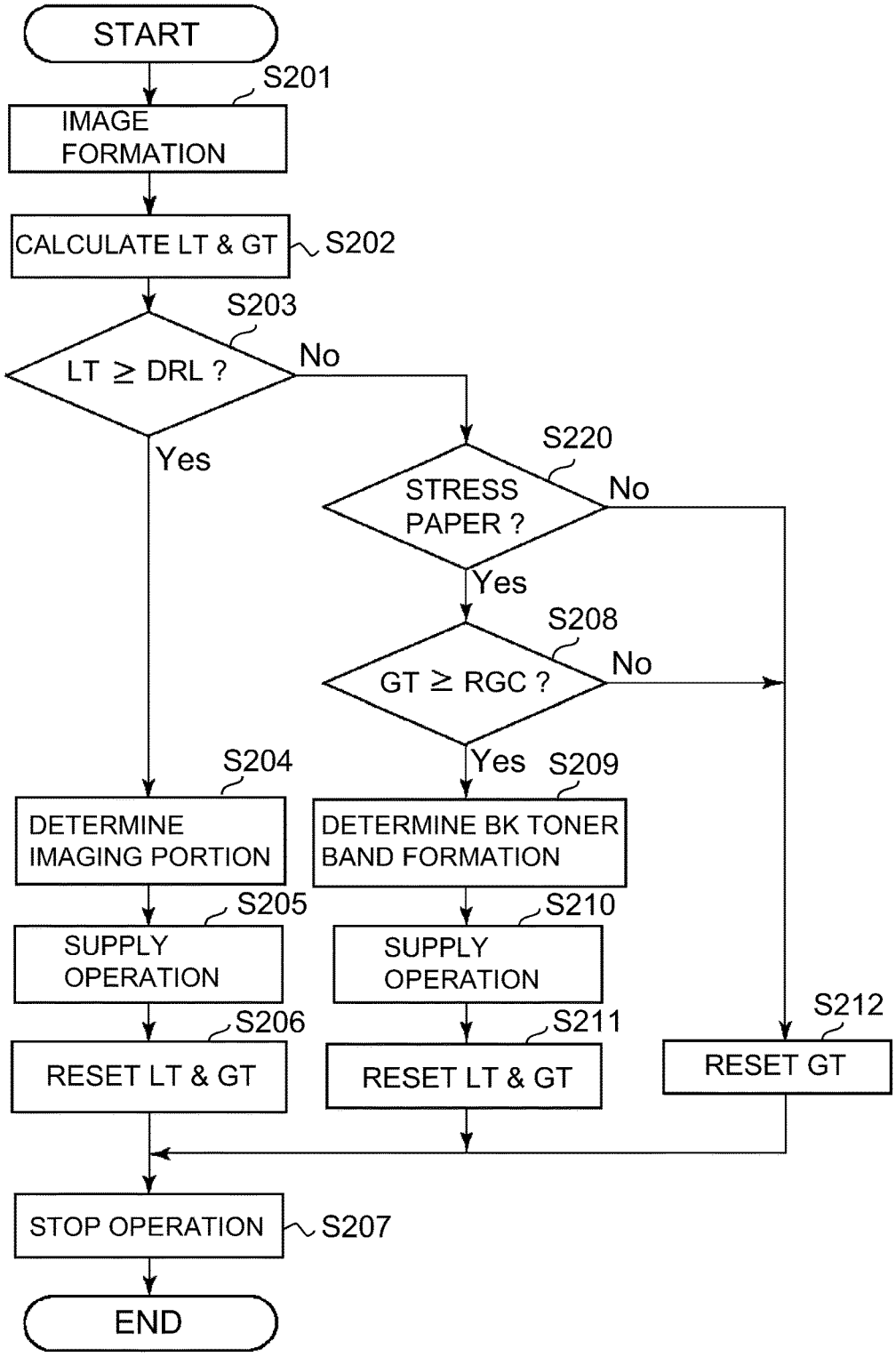

FIG. 15 is a flowchart of a procedure for executing a supplying operation in a post-rotation step in Embodiment 3.

Figure 16:
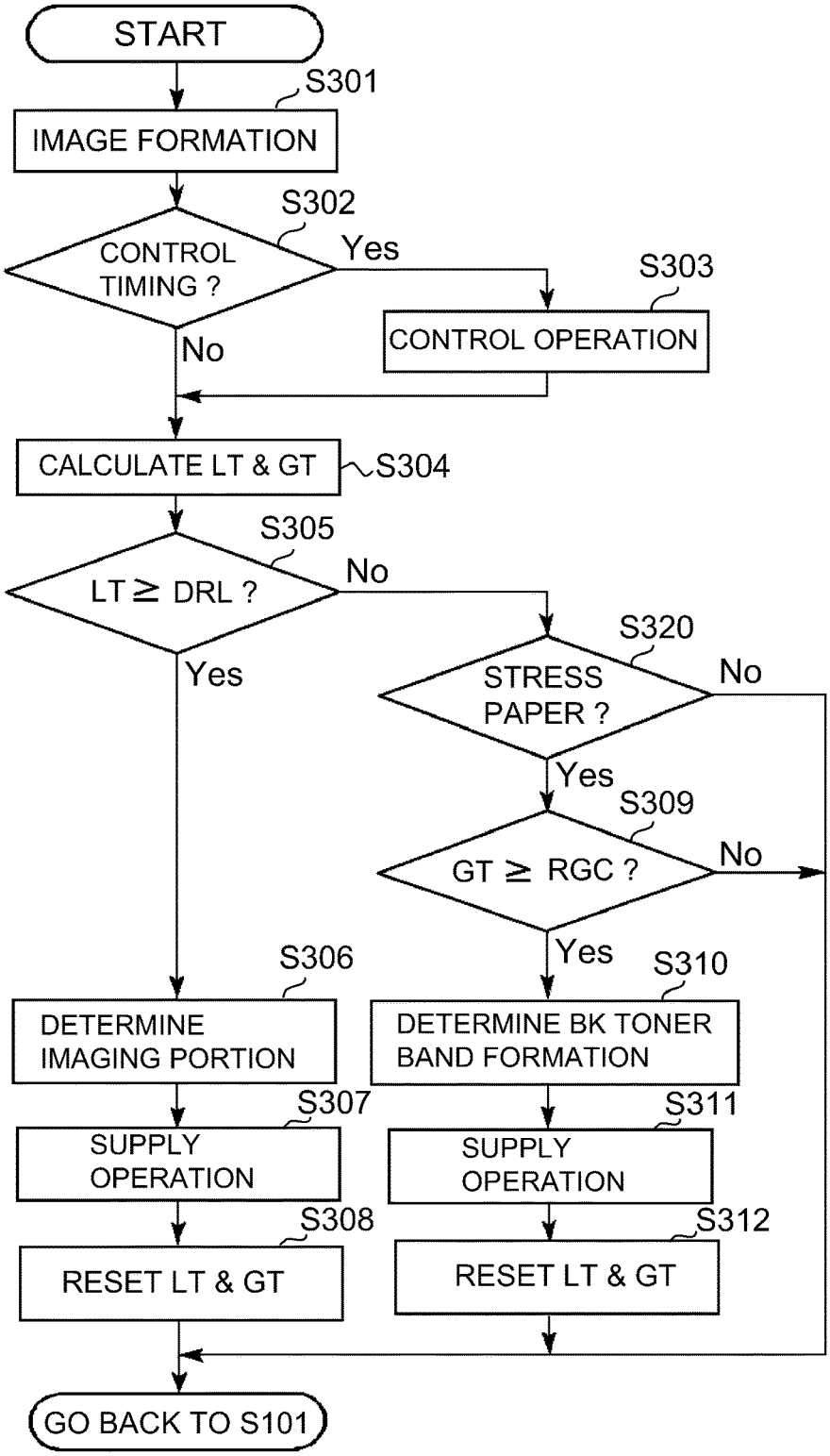

FIG. 16 is a flowchart of a procedure for executing a supplying operation in a sheet interval step in Embodiment 3.

DESCRIPTION OF THE EMBODIMENTS

An image forming apparatus according to the present invention will be specifically described with reference to the drawings.

Embodiment 1

1. General Constitution and Operation of Image Forming Apparatus

Figure 1:
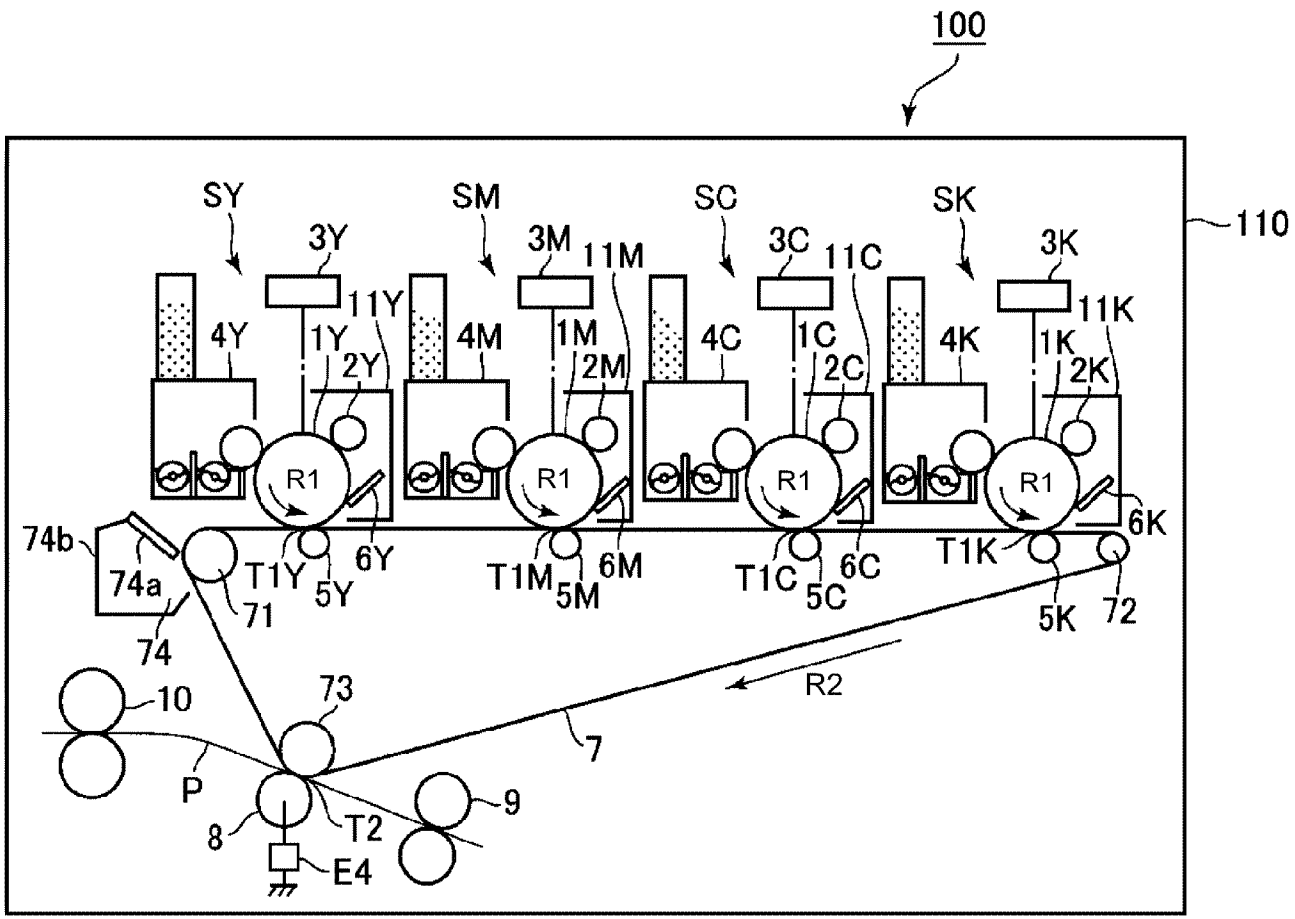
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type (in-line-type) multi-function machine which has functions of a copying machine, a printer and a facsimile machine and which employs an intermediary transfer type capable of forming a full-color image by using an electrophotographic type.

Figure 2:
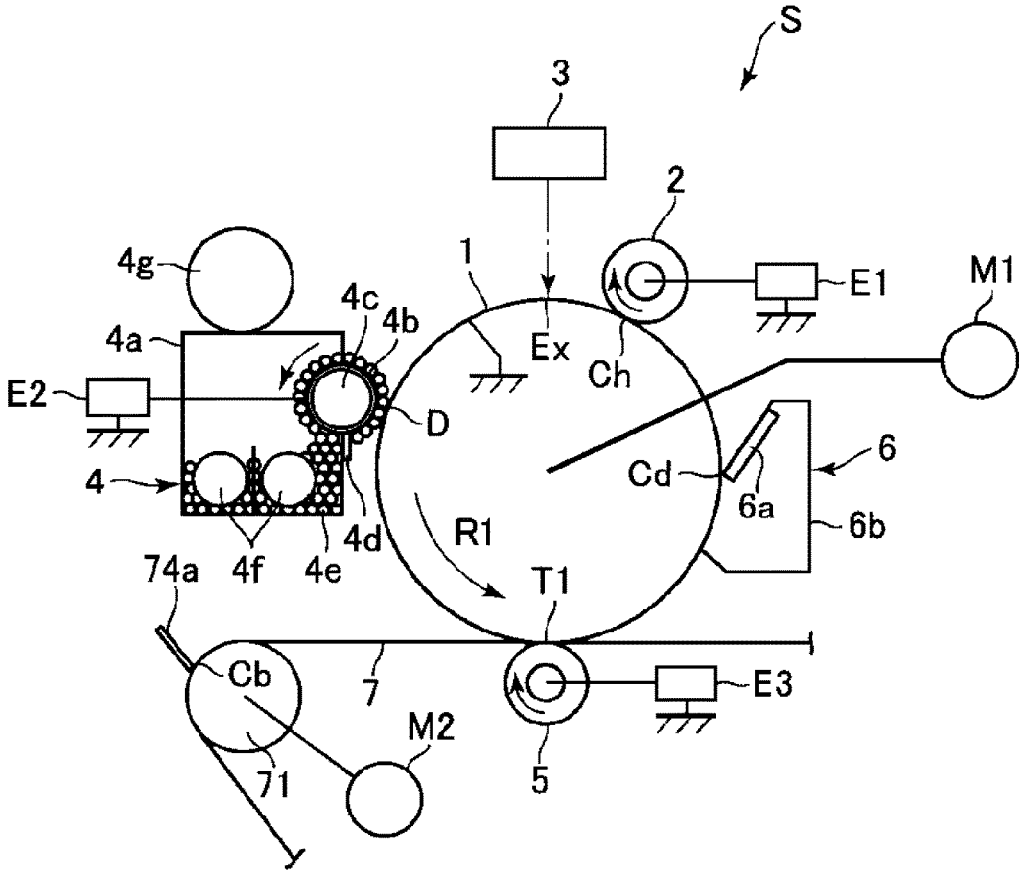
FIG. 2 is a schematic sectional view showing an image forming portion.

The image forming apparatus 100 includes, as a plurality of image forming portions, first to fourth image forming portions (stations) SY, SM, SC and SK for forming images of yellow (Y), magenta (M), cyan (C) and black (K), respectively. Incidentally, elements having the same or corresponding functions and constitutions in the respective image forming portions SY, SM, SC and SK are collectively described by omitting suffixes Y, M, C and K for representing elements for associated colors in some cases. FIG. 2 is a schematic sectional view showing a single image forming portion S as a representative. In this embodiment, the image forming portion S is constituted by including a photosensitive drum 1, a charging roller 2, an exposure device 3, a developing device 4, a primary transfer roller 5, a drum cleaning device 6, and the like, which are described later.

The image forming apparatus 100 includes the photosensitive drum 1 which is a rotatable drum-shaped (cylindrical) photosensitive member. The photosensitive drum 1 is an example of a movable image bearing member (first image bearing member) for bearing a toner image.

The photosensitive drum 1 is rotationally driven in an indicated arrow R1 direction (counterclockwise direction) at a predetermined peripheral speed (process speed) by a drum driving motor M1 (FIG. 2) as a driving means. In this embodiment, the photosensitive drum 1 is a negatively chargeable drum-shaped photosensitive member including an OPC (organic photoconductor layer) and is constituted by forming on substrate, a charge generating layer, a charge transporting layer and a surface layer in a named order. Further, in this embodiment, an outer diameter of the photosensitive drum 1 is 30 mm and a peripheral speed (process speed) of the photosensitive drum 1 is 100 mm/sec. Incidentally, a layer thickness of the surface layer can be appropriately selected in a range of about 0.01-30 μm, preferably 0.05-20 μm, further preferably 0.1-10 μm.

A surface of the rotating photosensitive drum 1 is electrically charged uniformly to a predetermined polarity (negative in this embodiment) and a predetermined potential by the charging roller 2 which is a roller-type charging member as a charging means. The charging roller 2 contacts the photosensitive drum 1 and is rotated by rotation of the photosensitive drum 1. During a charging step, to the charging roller 2, a charging voltage (charging bias) which is a DC voltage (DC component) having a predetermined polarity (negative in this embodiment) is applied. Incidentally, as the charging voltage, an oscillating voltage in the form of the DC voltage biased with an AC voltage may also be used. The charged surface of the charged photosensitive drum 1 is exposed to light by the exposure device 3 as an exposure means (electrostatic image forming means), so that an electrostatic image (electrostatic latent image) is formed on the photosensitive drum 1. In this embodiment, the exposure device 3 is a laser beam scanner using a semiconductor laser.

The electrostatic image formed on the photosensitive drum 1 is developed (visualized) with the developer by the developing device 4, so that the toner image is formed on the photosensitive drum 1. The developing device 4 is an example of a supplying means for supplying toner to the image bearing member. In this embodiment, the toner charged to the same polarity as a charge polarity (negative in this embodiment) of the photosensitive drum 1 is deposited on an exposed portion of the photosensitive drum 1, where an absolute value of a potential is lowered by subjecting the surface of the photosensitive drum 1 to the exposure by the laser beam after uniformly charging the surface of the photosensitive drum 1. That is, in this embodiment, a normal toner charge polarity which is the toner charge polarity during development is the negative polarity. In this embodiment in the developing device 4, as a developer, a two-component developer containing toner (non-magnetic toner particles) and a carrier (magnetic carrier particles) is used. The developing device 4 includes a developing container 4*a* accommodating a developer 4*e* and a developing sleeve 4*b* which is rotatably provided to the developing container 4*a* so as to be partly exposed to an outside through an opening of the developing container 4*a* and which is formed with a non-magnetic hollow cylindrical member. Inside (at the hollow portion of) the developing sleeve 4*b*, a magnet roller 4*e* is fixedly provided to the developing container 4*a*. The developing container 4*a* is provided with a regulating blade (developer chain-cutting member) 4*d* that opposes the developing sleeve 4*b*. Further, in the developing container 4*a*, two feeding screws 4*f* and 4*f* as feeding members for feeding the developer while stirring the developer are provided. Into the developing container 4*a*, toner is supplied appropriately from a toner hopper 4*g* as a supplying means. In this embodiment, the developing sleeve 4*b* and the feeding screws 4*f* and 4*f* are rotationally driven by transmitting thereto a driving force transmitted to the photosensitive drum 1. The developing sleeve 4*b* and the feeding screws 4*f* and 4*f* can be independently rotated and the rotation thereof can be independently stopped. In this embodiment, as the toner, toner prepared by externally adding, as an external additive, titanium oxide particles having an average particle size of 20 nm in a weight ratio of 1% in a negatively chargeable toner base material which is manufactured by a pulverizing method and which has an average particle size of 6 μm was used. Further, in this embodiment, as the carrier, a carrier of 205 emu/cm$^3$ in saturation magnetization and 35 μm in average particle size was used. Further, in this embodiment, a mixture of the toner and the carrier which are mixed in a weight ratio of 6:94 was used as the developer.

The developer 4*e* carried on the developing sleeve 4*b* by a magnetic force of the magnet roller 4*c* is fed to an opposing portion to the photosensitive drum 1 after an amount thereof is regulated by the regulating blade with rotation of the developing sleeve 4*b*. The developer 4*e* fed to the opposing portion to the photosensitive drum 1 is erected by the magnetic force of the magnet roller 4*c* and forms a magnetic brush (magnetic chain). In this embodiment, the developing sleeve 4*b* is disposed at least during a developing step so that a closest distance thereof with the photosensitive drum 1 is about 400 μm, so that the development is carried out in a state in which the magnetic brush of the developer on the developing sleeve 4*b* is contacted to the photosensitive drum 1. Further, during the development, to the developing sleeve 4*b*, from a developing voltage source (high-voltage source circuit) E2, as a developing voltage (developing bias), an oscillating voltage in the form of a DC voltage (DC component) biased with an AC voltage (AC component) is applied. The DC component of the developing voltage is set at a potential between a dark-portion potential (charge potential) and a light-portion potential (exposed portion potential) which are formed on the photosensitive drum 1. As a result, depending on the electrostatic latent image on the photosensitive drum 1, the toner is moved from the magnetic brush on the developing sleeve 4*b* onto the photosensitive drum 1, so that the toner image is formed on the photosensitive drum 1.

An intermediary transfer belt 7 constituted by an endless belt as an intermediary transfer member is provided so as to oppose the respective photosensitive drums 1. The intermediary transfer belt 7 is an example of a second image bearing member onto which the toner image (toner) is transferred from the first image bearing member such as the photosensitive drum 1. The intermediary transfer belt 7 is extended around a driving roller 71, a tension roller 72 and a secondary transfer opposite roller 73 which are used as stretching rollers, and is stretched with a predetermined tension. The intermediary transfer belt 7 is rotated (circulated) by rotationally driving the driving roller 71 in an indicated arrow R2 direction at a peripheral speed (process speed) substantially equal to the peripheral speed of the photosensitive drum 1 by a belt driving motor M2 (FIG. 2) as a driving means. In an inner peripheral surface side of the intermediary transfer belt 7, a primary transfer roller 5 which is a roller-type primary transfer member as a primary transfer means is provided corresponding to the associated photosensitive drum 1. The primary transfer roller 5 is pressed (urged) against the intermediary transfer belt 7 toward the photosensitive drum 1, so that a primary transfer portion T1 where the photosensitive drum 1 and the intermediary transfer belt 7 contact each other is formed. In this embodiment, as the intermediary transfer belt 7, a 75 μm-thick endless belt formed of polyimide resin (material) was used. The material constituting the intermediary transfer belt 7 is not limited to the polyimide resin, but it is possible to suitably use plastics such as polycarbonate resin, polyethylene terephthalate resin, polyvinylidene fluoride resin, polyethylene naphthalate resin, polyether ether ketone resin, polyether sulfone resin and polyurethane resin, and rubbers such as a fluorine-based rubbers and silicone-based rubbers. Further, the thickness of the intermediary transfer belt 7 is not limited to 75 but can be appropriately selected in a range of about 25-2000 preferably 50-150 In this embodiment, as the primary transfer roller 5, a roller of $1\times10^5$-$1\times10^7\Omega$ in electric resistance, 30 mm in outer diameter and 340 mm in length with respect to a rotational axis direction was used.

The toner image formed on the photosensitive drum 1 as described above is primary-transferred by the action of an electrostatic force and pressure imparted by the primary transfer roller 5 onto the intermediary transfer belt 7 at the primary transfer portion T1. During a primary transfer step, to the primary transfer roller 5, a primary transfer voltage primary transfer bias) which is a DC voltage of an opposite polarity to the normal charge polarity of the toner is applied from a primary transfer voltage source (high-voltage source circuit) E3. In this embodiment, the primary transfer voltage is subjected to contact-current control so that a current (target current) of +15 μA flows through the primary transfer roller 5. For example, during full-color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller 8 which is a roller-type secondary transfer member as a secondary transfer means is provided. The secondary transfer roller 8 is pressed (urged) against the intermediary transfer belt 7 toward the secondary transfer opposite roller 73 and forms a secondary transfer portion T2 where the intermediary transfer belt 7 and the secondary transfer roller 8 are in contact with each other. The toner images formed on the intermediary transfer belt 7 as described above are secondary-transferred by the action of an electrostatic force and pressure imparted by the secondary transfer roller 8 onto a transfer(-receiving) material P, such as a recording sheet, nipped and fed at the secondary transfer portion T2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source (high-voltage source circuit) E4.

The recording material (sheet, transfer material) P such as a recording sheet is fed one by one from a feeding device (not shown) to a registration roller pair 9, and is timed to the toner images on the intermediary transfer belt 7 by the registration roller pair 9 and then is supplied to the secondary transfer portion T2. Further, the recording material P on which the toner images are transferred is fed to a fixing device 10 and is heated and pressed by the fixing device 10, so that the toner images are fixed (melt-fixed) on the transfer material P. Thereafter, the recording material P on which the toner images are fixed is discharged (outputted) to an outside of the apparatus main assembly 110 of the image forming apparatus 100.

On the other hand, toner (primary transfer residual toner) remaining on the photosensitive drum 1 during the primary transfer is removed and collected from the surface of the photosensitive drum 1 by a drum cleaning device 6 as a photosensitive member cleaning means. The drum cleaning device 6 includes a first cleaning blade 6*a* (hereinafter referred also to as a first blade) as a cleaning member and includes a first cleaning container 6*b*. The drum cleaning device 6 rubs the surface of the rotating photosensitive drum 1 with the first cleaning blade 6*a* provided in contact with the photosensitive drum 1. As a result, the primary transfer residual toner on the photosensitive drum 1 is scraped off from the photosensitive drum 1 and is accommodated in the first cleaning container 6*b*.

Further, on an outer peripheral surface side of the intermediary transfer belt 7, a belt cleaning device 74 as an intermediary transfer member cleaning means is provided at a position opposing the driving roller 71. Toner (secondary transfer residual toner) remaining on the surface of the intermediary transfer belt 7 during a secondary transfer step is removed and collected from the surface of the intermediary transfer belt 7 by the belt cleaning device 74. The belt cleaning device 74 includes a second cleaning blade 74*a* (hereinafter referred also to as a second blade) as a cleaning member and includes a first cleaning container 74*b*. The belt cleaning device 74 rubs the surface of the rotating intermediary transfer belt 7 with the second cleaning blade 74*a* provided in contact with the intermediary transfer belt 7. As a result, the secondary transfer residual toner on the intermediary transfer belt 7 is scraped off from the intermediary transfer belt 7 and is accommodated in the second cleaning container 74*b*. The toners accommodated in the first and second cleaning containers 6*b* and 74*b* are fed by feeding members (feeding screws) (not shown) provided in the first and second cleaning containers 6*b* and 74*b* and then are collected in a residual toner container (not shown).

In this embodiment, at each of the image forming portions S, the photosensitive drum 1, the charging roller 2 and the drum cleaning device 6 integrally constitute a cartridge (drum cartridge) 11 detachably mountable to the apparatus main assembly 110 of the image forming apparatus 100. Further, in this embodiment, the developing device 4 is singly detachably mountable to the apparatus main assembly 110 of the image forming apparatus 10.

Here, a position, with respect to the rotational direction of the photosensitive drum 1, where the photosensitive drum 1 is charged by the charging roller 2 is a charging position Ch. The charging roller 2 charges the photosensitive drum 1 by electric discharge generating in at least one of minute gaps formed between the charging roller 2 and the photosensitive drum 1 on sides upstream and downstream of the contact portion between the charging roller 2 and the photosensitive drum 1 with respect to the rotational direction of the photosensitive drum 1. However, for simplicity, it may also be considered that the contact portion between the charging roller 2 and the photosensitive drum 1 is deemed to be the charging position. Further, with respect to the rotational direction of the photosensitive drum 1, a position where the photosensitive drum 1 is exposed to light by the exposure device 3 is an exposure position Ex. Further, with respect to the rotational direction of the photosensitive drum 1, a position where the toner is supplied from the developing sleeve 4*b* to the photosensitive drum 1 (an opposing portion between the developing sleeve 4*b* and the photosensitive drum 1 in this embodiment) is a developing position D. Further, with respect to the rotational direction, a position where the toner image is transferred from the photosensitive drum 1 onto the intermediary transfer belt 7 (a contact portion between the photosensitive drum 1 and the intermediary transfer belt 7 in this embodiment) is a primary transfer position (primary transfer portion) T1. Further, with respect to the rotational direction of the photosensitive drum 1, a contact portion between the first blade 6*a* and the photosensitive drum 1 is a first cleaning position Cd. Further, with respect to the rotational direction of the intermediary transfer belt 7, a contact portion between the second blade 74*a* and the intermediary transfer belt 7 is a second cleaning position Cb.

Further, the image forming apparatus 100 performs a job (print operation) which is a series of operations which are started by a start instruction and in which an image is formed on a single recording material P or on a plurality of recording materials P and then the recording materials P are outputted. The job generally includes an image forming step, a pre-rotation step, a sheet interval step in the case where the image is formed on the plurality of the recording materials P, and a post-rotation step. The image forming step is a period in which formation of the electrostatic image for an image formed and outputted on the recording material P, formation of the toner image, and primary transfer and secondary transfer of the toner image are actually performed, and the "image forming period (during image formation)" refers to this period. Specifically, at each of positions where steps of effecting the formation of the electrostatic image, the formation of the toner image, and the primary transfer and the secondary transfer of the toner image, timing in the image forming period is different. The pre-rotation step is a period in which a preparatory operation, from input of the start instruction until the image formation is actually started, is performed before the image forming step. The sheet interval step is a period corresponding to an interval between a recording material P and a subsequent recording material P when the image formation is continuously performed (continuous image formation) with respect to the plurality of recording materials P. The post-rotation step is a period in which a post-operation (preparatory operation) is performed after the image forming step. "Non-image-forming period (during non-image-formation)" refers to a period other than the "image forming period", and includes the pre-rotation step, the sheet interval step, the post-rotation step and further includes a pre-multi-rotation step which is a preparatory operation during main switch actuation of the image forming apparatus 100 or during restoration from a sleep state.

2. Cleaning Device

Next, constitutions of the drum cleaning device 6 and the belt cleaning device 74 will be further described.

In this embodiment, the drum cleaning device 6 includes the first blade 6*a* formed of polyurethane (urethane rubber) as an elastic material. The first blade 6*a* is a plate-like (blade-like) member having a predetermined length with respect to a longitudinal direction along a direction substantially perpendicular to a surface movement direction (traveling direction) of the photosensitive drum 1, a predetermined length with respect to a widthwise direction substantially perpendicular to the longitudinal direction, and a predetermined thickness. The first blade 6*a* is bonded to a metal-made supporting member (metal plate) by (thermal) welding in a predetermined range of a fixed end portion which is one end portion thereof with respect to the widthwise direction, and this supporting member is fixed to the first cleaning container 6*b*, so that the first blade 6*a* is supported by the first cleaning container 6*b*. Further, the first blade 6*a* contacts the surface of the photosensitive drum 1 at an edge portion of a free end portion opposite from the fixed end portion with respect to the widthwise direction so that the free end portion extends in a counter direction in which the free end portion is oriented toward an upstream side with respect to the rotational direction (surface movement direction, traveling distance) of the photosensitive drum 1. In this embodiment, specific setting of the first blade 6*a* is as follows:

a) cleaning blade free length: 8 mm,
b) cleaning blade longitudinal length: 325 mm,
c) cleaning blade contact line pressure: 3.1 N/cm,
d) cleaning blade contact angle: 30°,
e) cleaning blade contact type: counter contact, and
f) hardness: 75° (JIS-A standard).

In this embodiment, the belt cleaning device 74 includes the second blade 74*a* formed of polyurethane (urethane rubber) as an elastic material. The second blade 74*a* is a plate-like (blade-like) member having a predetermined length with respect to a longitudinal direction along a direction substantially perpendicular to a surface movement direction (traveling direction) of the intermediary transfer belt 7, a predetermined length with respect to a widthwise direction substantially perpendicular to the longitudinal direction, and a predetermined thickness. The second blade 74*a* is bonded to a metal-made supporting member (metal plate) by (thermal) welding in a predetermined range of a fixed end portion which is one end portion thereof with respect to the widthwise direction, and this supporting member is fixed to the second cleaning container 74*b*, so that the second blade 74*a* is supported by the second cleaning container 74*b*. Further, the second blade 74*a* contacts the surface of the intermediary transfer belt 7 at an edge portion of a free end portion opposite from the fixed end portion with respect to the widthwise direction so that the free end portion extends in a counter direction in which the free end portion is oriented toward an upstream side with respect to the rotational direction (surface movement direction, traveling distance) of the intermediary transfer belt 74. In this embodiment, specific setting of the second blade 74*a* is as follows:

a) cleaning blade free length: 8 mm,
b) cleaning blade longitudinal length: 330 mm,
c) cleaning blade contact line pressure: 2.8 N/cm,
d) cleaning blade contact angle: 30°,
e) cleaning blade contact type: counter contact, and
f) hardness: 77° (JIS-A standard).

3. Control Mode

Figure 3:
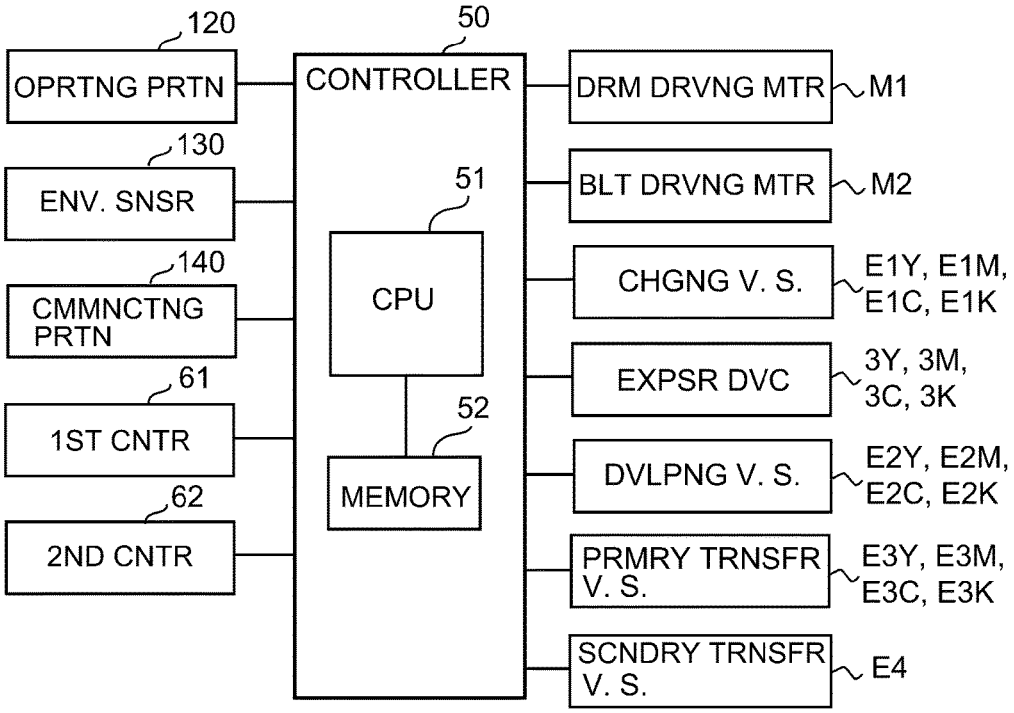
FIG. 3 is a schematic block diagram showing a control mode of a principal part of the image forming apparatus.

FIG. 3 is a schematic block diagram showing a control mode of a principal part of the image forming apparatus 100 of this embodiment. The apparatus main assembly 110 of the image forming apparatus 100 includes a controller (control circuit) 50 as a control means. The controller 50 is constituted by a CPU 51 as a calculation (computation) control means, a memory (ROM, RAM) 52 as a storing means, and the like. The controller 50 effects integrated control of operations of the respective portions of the image forming apparatus 100 by executing a process by the CPU 51 in accordance with a program stored in the memory 52. To the controller 50, for example, a drum driving motor M1 for driving the respective photosensitive drums 1, a belt driving motor M2 for driving the intermediary transfer belt 7 and the exposure devices 3 for exposing the photosensitive drums 1 to light are connected. Further, to the controller 50, the charging voltage sources E1 for applying the charging voltage to the charging rollers 2, the developing voltage sources E2 for applying the developing voltage to the developing sleeves 4*b*, the primary transfer voltage sources E3 for applying the primary transfer voltage to the primary transfer rollers 5 and the secondary transfer voltage source E4 for applying the secondary transfer voltage to the secondary transfer roller 8 are connected. Further, to the controller 50, an operating portion (operating panel) 120 provided on the apparatus main assembly 110 is connected. The operating portion 120 is provided with keys as an inputting means for inputting various settings relating to image formation to the controller 50 and with a display panel as a display means for displaying information to an operator such as a user or a service person. Further, to the controller 50, an environment sensor (temperature/humidity sensor) 130 as an environment detecting means for detecting at least one of a temperature and a humidity in at least one of an inside and an outside of the apparatus main assembly is connected. Further, to the controller 50, a communicating portion 140 for establishing communication with an external device (such as a personal computer or an image scanner) of the image forming apparatus 100 is connected.

The controller 50 transmits operation control commands to the respective portions of the image forming apparatus 100 depending on information designating an image forming condition inputted from the operating portion 120 or the communicating portion 140 or depending on environment information inputted from the environment sensor 130. As a result, the image forming operation and a supplying operation described later are executed. Incidentally, as the image forming condition, it is possible to cite a sheet size, a sheet kind, an information (output sheet number), an image quality mode and the like.

Incidentally, a first counter 61 and a second counter 62 shown in FIG. 3 will be described later.

4. Outline of Supplying Operation

The image forming apparatus 100 of this embodiment is capable of executing the supplying operation for supplying the toner to the first cleaning position Cd and a second cleaning position Cb in a non-image-forming period. In this embodiment, the supplying operation is carried out, whereby a sliding property between the photosensitive drum 1 and the first blade 6*a* and a sliding property between the intermediary transfer belt 7 and the second blade 74*a* are maintained. Further, in this embodiment, by executing the supplying operation, deposition of paper powder principally at the second cleaning position Cb is suppressed.

Specifically, in the supplying operation, on the photosensitive drum 1, a line-like or band-like toner image (herein, also referred to as a "toner band") extending along a direction substantially perpendicular to the traveling distance of the photosensitive drum 1. That is, the toner band is a toner image extending along the longitudinal direction of the first and second cleaning members 6*a* and 74*a* (first and second cleaning positions Cd and Cb). In this embodiment, the toner band is formed through the charging step, the exposure step and the developing step on the photosensitive drum 1 similarly as in a normal image forming period. In this embodiment, the toner band formed on the photosensitive drum 1 is transferred onto the intermediary transfer belt 7 at the primary transfer portion T1. As a result, a part of toner of the toner band (herein, this toner is referred to as a "band toner") is supplied as transfer residual toner to the first cleaning position Cd, and another part of the band toner transferred on the intermediary transfer belt 7 is supplied to the second cleaning position Cb. When the toner band passes through the secondary transfer portion T2, from the secondary transfer voltage source E4 to the secondary transfer roller 8, a voltage of an opposite polarity (i.e., the same polarity as the normal charge polarity of the toner) is applied, so that deposition of the band toner on the secondary transfer roller 8 is suppressed. Or, a spacing mechanism as a spacing means for spacing the secondary transfer roller 8 from the intermediary transfer belt 7 is provided, so that the secondary transfer roller 8 may also be spaced from the intermediary transfer belt 7 when the toner band passes through the secondary transfer portion T2. The band toner is supplied to the first cleaning position Cd, so that the lubricant (principally the external additive of the toner) is supplied to between the photosensitive drum 1 and the first blade 6*a*. Further, the band toner is supplied to the second cleaning position Cb, so that the lubricant (principally the external additive of the toner) is supplied to between the intermediary transfer belt 7 and the second blade 74*a*. At the same toner image, the barrier with the toner is formed in the neighborhood of the contact portion between the intermediary transfer belt 7 and the second blade 74*a*.

Figure 4:
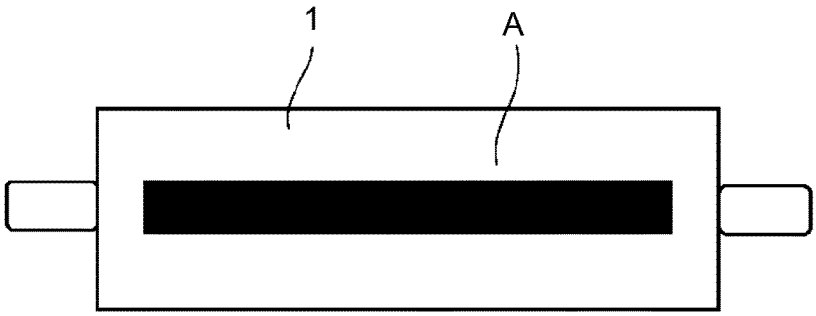
FIG. 4 is a schematic view of a toner band.

Typically, this toner band is a line-like or band-like toner image extending over an entire area of an image formable region with respect to a direction (also referred to as a thrust direction) substantially perpendicular to the traveling distance of the intermediary transfer belt 7. However, this toner image may also be single or a plurality of toner images formed in an arbitrary length with respect to a direction crossing the surface movement directions of the photosensitive drum 1 and the intermediary transfer belt 7. FIG. 4 is a schematic view showing a shape of a toner band A formed on the photosensitive drum 1. In this embodiment, the toner band A was a band-like toner image which is 320 mm in length with respect to the thrust direction, 10 mm in length with respect to the traveling distance and FFH (maximum density level (solid image) of 256 levels from 0 to 255) in density.

5. Execution Timing of Supplying Operation

Next, execution timing of the supplying operation will be described. Incidentally, in this embodiment, as regards the image formation number, formation of an image on one surface (side) of a single (one) recording material P is counted as "one (toner image)"). Further, the continuous image formation number is an information designated in a single job, and a control operation (image density adjusting control or registration adjusting control or the like control) may also be executed between certain image formation and subsequent image formation during execution of the single job.

5-1. Maintenance of Sliding Property

First, the supplying operation execution timing relating to maintenance of the sliding property, between the photosensitive drum 1 and the first blade 6*a* will be described.

Figure 5:
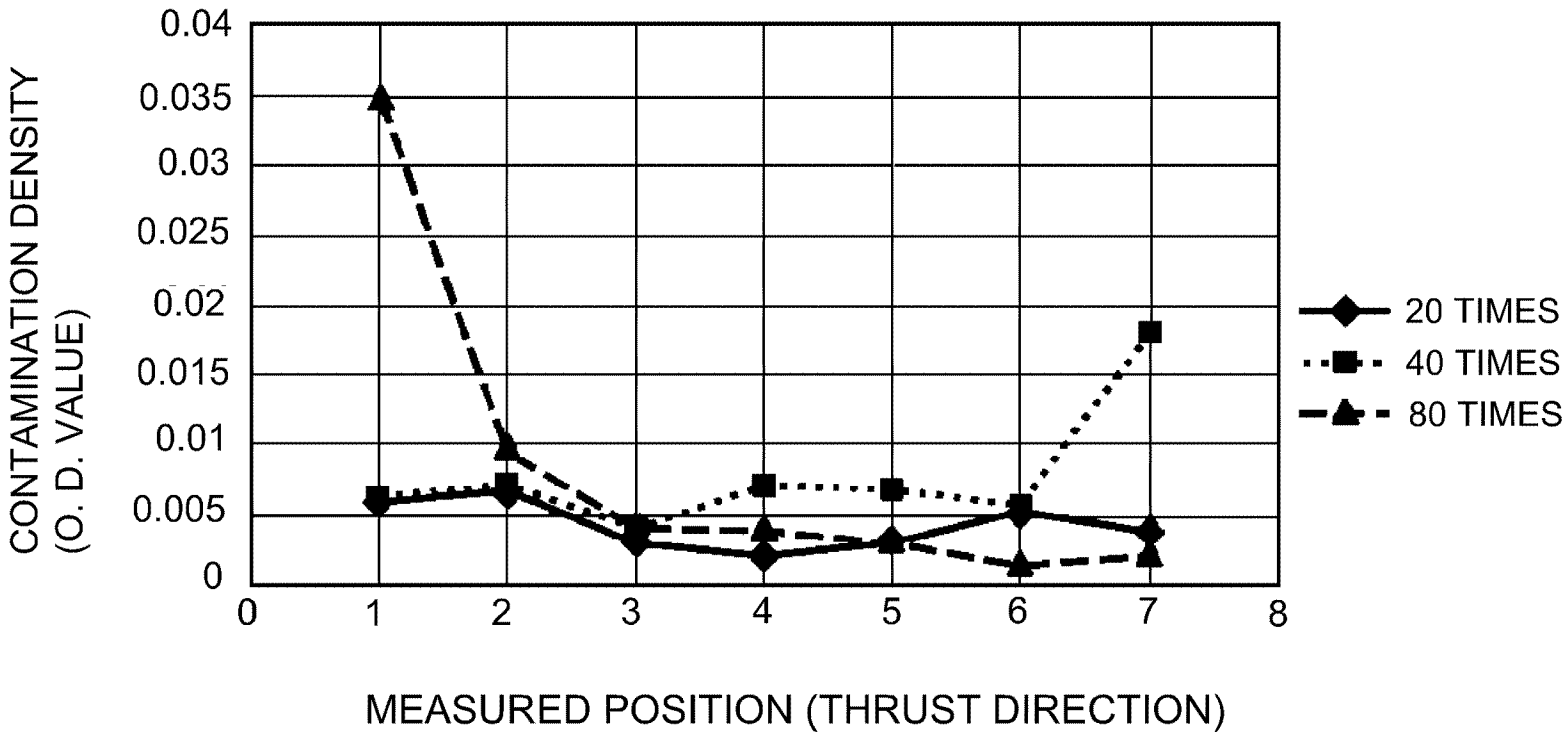
FIG. 5 is a graph for illustrating relationship between a contaminant amount of a charging roller and an execution interval of a supplying operation.

FIG. 5 is a graph showing a relationship between a supplying operation execution frequency and an amount of contamination with the toner on the surface of the charging roller 2 by a phenomenon that the toner slips through the first blade 6*a* due to abnormal vibration (shuddering) of the first blade 6*a*. In FIG. 5, the abscissa represents a position (measuring place) with respect to the thrust direction of the charging roller 2, and the ordinate represents a measurement result of a contaminant amount on the surface of the charging roller 2. Measurement of the contaminant amount on the surface of the charging roller 2 was carried out in the following manner. In an environment of high temperature/high humidity (32° C./82% RH), continuous image formation of images (solid white images) each with an image density OOH on one surface of an A4-size sheet was carried out 5,000 toner images (5,000 sheets). Thereafter, a transparent tape was applied onto the surface of the charging roller 2, and then is peeled off and was applied onto white paper, followed by measurement of density (optical density) with a densitometer ("Model 528", manufactured by X-Rite Inc.). Then, a difference between a measured value of the density thereof and a measured value of the density of a transparent tape applied onto white paper without being applied onto the charging roller 2 was used as the contaminant amount on the surface of the charging roller 2. This experiment was conducted in each of the cases where the supplying operation was performed 20 toner images, 40 toner images and 80 toner images in terms of the image formation number during the continuous image formation.

From FIG. 5, it is understood that abnormal vibration of the first blade 6*a* is suppressed with an increasing execution frequency (i.e., a decreasing execution interval) of the supplying operation and thus the contaminant amount on the charging roller 2 by the toner decreases. This is an increase in frictional force between the photosensitive drum 1 and the first blade 6*a* correlates with a degree of a decrease in amount of the lubricant between the photosensitive drum 1 and the first blade 6*a* due to traveling of the photosensitive drum 1.

In the constitution of this embodiment, when a traveling distance of the photosensitive drum 1 exceeds 150,000 mm, in the case where formation of images with an excessively low image ratio is continued, the sliding property between the photosensitive drum 1 and the first blade 6*a* lowers and thus abnormal vibration of the first blade 6*a* occurs in some instances. For that reason, in the constitution of this embodiment, in order to sufficiently maintain the sliding property between the photosensitive drum 1 and the first blade 6*a*, it is desirable that the supplying operation is executed every traveling distance of 130,000 mm of the photosensitive drum 1. Incidentally, the image ratio refers to a proportion of an image area to an area of a maximum image formable region.

Further, also execution timing of the supplying operation relating to maintenance of the sliding property between the intermediary transfer belt 7 and the second blade 74*a* was subjected to a study similar to the study described above. As a result, in the constitution of this embodiment, it turned out that also the sliding property between the intermediary transfer belt 7 and the second blade 74*a* can be sufficiently maintained by executing the supplying operation at timing suitable for maintenance of the sliding property between the intermediary transfer belt 7 and the second blade 74*a* can be sufficiently maintained. That is, in this embodiment, drive and a stop of the drive of the intermediary transfer belt 7 are carried out in synchronism with the photosensitive drum 1. Further, an increase in frictional force between the intermediary transfer belt 7 and the second blade 74*a* correlates with a degree of a decrease in amount of the lubricant between the intermediary transfer belt 7 and the second blade 74*a* in this embodiment.

In the constitution of this embodiment, when a traveling distance of the intermediary transfer belt 7 (i.e., the photosensitive drum 1) exceeds 150,000 mm, the sliding property between the intermediary transfer belt 7 and the second blade 74*a* lowers and thus abnormal vibration of the second blade 74*a* occurs in some instances. For that reason, in the constitution of this embodiment, in order to sufficiently maintain the sliding property between the intermediary transfer belt 7 and the second blade 74*a*, it is desirable that the supplying operation is executed every traveling distance of 130,000 mm of the intermediary transfer belt 7 (i.e., the photosensitive drum 1). Incidentally, the traveling distance of 130,000 mm of the photosensitive drum 1 corresponds to the traveling distance of the photosensitive drum 1 in the case where the continuous image formation of A4-size sheets (short edge feeding) is carried out roughly 500 toner images.

Thus, by executing the supplying operation on the basis of the traveling distance of the photosensitive drum 1, compared with the case of execution of the supplying operation on the basis of cumulative image formation number, the supplying operation can be executed efficiently, so that unnecessary toner consumption and a lowering in lifetime of the member can be suppressed.

5-2. Suppression of Deposition of Paper Powder

Next, execution timing of the supplying operation relating to suppression of deposition of the paper powder will be described.

In the constitution of this embodiment, a phenomenon that resulting from the paper powder deposition, the toner slips through the cleaning belt is problematic principally at the second cleaning position Cb. Accordingly, in this embodiment, description will be made by paying attention to suppression of the deposition of the paper powder in the neighborhood of the contact portion between the intermediary transfer belt 7 and the second blade 74*a*. Further, in this embodiment, the term "paper powder" is used, but the "paper powder" mean an arbitrary substance (foreign matter), in general, capable of causing improper cleaning by deposition thereof in the neighborhood of the contact portion between the image bearing member and the cleaning member.

The paper powder includes an arbitrary substance, derived from principally a component of the recording material P, which is deposited on the recording material P by being generated from the recording material P during processing such as cutting of the recording material P and which is deposited on the recording material P by being generated from the recording material P due to sliding of the recording material P an another member in the image forming apparatus 100. Typically, the paper powder is constituted by fibers containing cellulose as a main component and by a filler such as powder of calcium carbonate.

Parts (a) to (c) of FIG. 6 are schematic views for illustrating a mechanism of occurrence of a phenomenon that the toner slips through the second blade 74*a* due to the paper powder deposition. Part (a) of FIG. 6 shows a state of the neighborhood of the second blade 74*a* in a period (a torque peak and later) in which a torque exerted on an edge portion e of the second blade 74*a* is low. In this period, a degree of deformation of the edge portion e of the second blade 74*a* is small, and therefore, a space in which photosensitive drum f (such as oblate photosensitive drum) can deposit at a deformed portion is small. Accordingly, the paper powder cannot deposit to the extent such that the paper powder lifts the edge portion e of the second blade 74*a*, so that a degree of the paper powder deposit does not lead to generation of a starting point from which toner t slips through the second blade 74*a*. Next, part (b) of FIG. 6 shows a state of the neighborhood of the second blade 74*a* in a period (from an initial stage to the torque peak) in which a torque exerted on an edge portion e of the second blade 74*a* increases. In this period, the edge portion e of the second blade 74*a* deforms in the traveling distance of the intermediary transfer belt 7, and therefore, the photosensitive drum f (such as the oblate photosensitive drum or calcium carbonate as a filler component) deposits between the deformed portion and the intermediary transfer belt 7. Further, the photosensitive drum f lifts the edge portion e of the second blade 74*a* (i.e., a part of the paper powder f is sandwiched between the intermediary transfer belt 7 and the second blade 74*a*), so that a starting point from which toner t slips through the second blade 74*a* is formed. Next, part (c) of FIG. 6 shows a state of the neighborhood of the second blade 74*a* in a period (before and after the torque peak) in which a torque exerted on an edge portion e of the second blade 74*a* is high. In this embodiment, for example, in a region of a nip width between the intermediary transfer belt 7 and the second blade 74*a*, a state (such as a tangentially contacted state) in which a peak pressure at the edge portion e of the second blade 74*a* is high is formed. Then, the toner t starts to slip through the second blade 74*a* from, as a starting point, a place where the deposited paper powder f lifts the edge portion e of the second blade 74*a* (i.e., a part of the paper powder f is sandwiched between the intermediary transfer belt 7 and the second blade 74*a*).

Parts (a) and (b) of FIG. 7 are schematic views for illustrating a mechanism for suppressing the improper cleaning due to the paper powder deposition by supplying the toner band to the second cleaning position Cb. Part (a) of FIG. 7 shows a state of the neighborhood of the second blade 74*a* in a period (torque peak and later) in which a torque exerted on an edge portion e of the second blade 74*a* is low. In this period, as described above with reference to part (a) of FIG. 6, the toner t does not slip through the second blade 74*a*. In this state, i.e., before the states described above with reference to parts (b) and (c) of FIG. 6, supply of the toner band A to the second cleaning position Cb is important to suppress that the toner t slips through the second blade 74*a* due to the paper powder deposition (i.e., the improper cleaning). That is, the above period is before the torque exerted on the second blade 74*a* becomes high and the edge portion e of the second blade 74*a* starts to deform and thus a state (such as the tangentially contacted state) in which the peak pressure at the edge portion e of the second blade 74*a* is high in a region of the nip width is formed. As a result, as shown in part (b) of FIG. 7, deformation of the edge portion e of the second blade 74*a* is suppressed, and a barrier with the band toner t for preventing the paper powder f to entering between the intermediary transfer belt 7 and the second blade 74*a* is formed in the neighborhood of the edge portion e. Incidentally, the barrier with the toner t is formed specifically in a space between a free end surface of the second blade 74*a* and the surface of the intermediary transfer belt 7 on a side upstream of the edge portion e of the second blade 74*a* with respect to the surface movement direction of the intermediary transfer belt 7. As a result, the deposition of the paper powder fin the neighborhood of the contact portion between the intermediary transfer belt 7 and the second blade 74*a* is prevented, so that it is possible to suppress that the toner t slips through the second blade 74*a*.

Thus, the occurrence of the improper cleaning resulting from the paper powder deposition at the second cleaning position Cb correlates with the frictional force between the intermediary transfer belt 7 and the second blade 74*a* and a degree of a decrease in barrier with the toner in the neighborhood of the edge portion e of the second blade 74*a*. For that reason, in many cases, by executing the supplying operation at the above-described timing suitable for maintenance of the sliding property between the intermediary transfer belt 7 and the second blade 74*a*, the barrier with the toner is sufficiently formed, so that the improper cleaning resulting from the paper powder deposition can be suppressed. That is, in the constitution of this embodiment, in order to sufficiently suppress the improper cleaning resulting from the paper powder deposition, the supplying operation may only be required to be executed every traveling distance of 130,000 mm of the intermediary transfer belt 7 (i.e., the photosensitive drum 1). As described above, this traveling distance corresponds to the traveling distance in the case where the continuous image formation of the images on the A4-size sheets (short edge feeding) is carried out roughly 500 toner images.

5-3. Execution Timing of Supplying Operation in this Embodiment

From the viewpoints of the maintenance of the sliding property at the first and second cleaning positions Cd and Cb and the suppression of the paper powder deposition principally at the second cleaning position Cb as described above, in this embodiment, the supplying operation is executed in principle using, as a threshold, the traveling distance corresponding to the continuous image formation number of 500 toner images.

On the other hand, the degree such that the improper cleaning resulting from the paper powder deposition at the second cleaning position Cb is liable to occur also correlates with the image formation number, particularly the image formation number designated in a single job (i.e., the continuous image formation number). This is because during the continuous image formation, the paper powder from the paper used as the recording material P is continuously sent to the second cleaning position Cb. By setting the threshold of the traveling distance as described above, in the case where a job with the continuous image formation number of 500 toner images is repeated, in many instances, the supplying operation is executed at timing corresponding to the cumulative image formation number of 500 toner images or less. Particularly, in the constitution of this embodiment, in the case where a job with the continuous image formation number of 400 toner images or less is repeated, the supplying operation is executed at timing corresponding to the cumulative image formation number of 400 toner images or less with reliability. This is roughly because when the image formation number designated in the single job (i.e., the continuous image formation number) is different, the traveling distance of the image bearing member relative to the cumulative image formation number is different. That is, the job is in general constituted by including the image forming step, the pre-rotation step, the sheet interval step and the post-rotation step. In the case where a job with a relative small designated image formation number is repeated, a proportion of the traveling distance for the pre-rotation step and the post-rotation step to an entirety of the traveling distance of the image bearing member increases, and therefore, the traveling distance of the image bearing member relative to the cumulative image formation number becomes relatively large. On the other hand, in a job with a relatively large designated image formation number, the proportion of the traveling distance for the pre-rotation step and the post-rotation step to the entirety of the traveling distance of the image bearing member decreases, and therefore, the traveling distance of the image bearing member relative to the cumulative image formation number (the continuous image formation number in this case) becomes relatively small.

However, in the case where a job with the continuous image formation number of 500 toner images or more is executed, it turned out that an actual traveling distance exceeds a traveling distance corresponding to the continuous image formation number of 500 toner images which is normally estimated and thus a state in which the improper cleaning resulting from the paper powder deposition is liable to occur is formed in some instances. This is because the control operation (such as the image density adjusting operation or the registration adjusting operation) is irregularly carried out during the continuous image formation. That is, it turned out that when the supplying operation is executed using only the threshold set on the basis of the traveling distance, the supplying operation cannot be executed at timing necessary to suppress the improper cleaning resulting from the paper powder deposition in some instances.

Thus, when the supplying operation is executed on the basis of only the traveling distance of the photosensitive drum 1, the unnecessary consumption of the toner and the lowering in lifetime of the member can be suppressed, but there is a liability that the improper cleaning resulting from the position deposition cannot be suppressed.

Therefore, in this embodiment, as a threshold discriminating whether or not the supplying operation should be executed, a threshold (first threshold) on the basis of the traveling distance of the photosensitive drum 1 and a threshold (second threshold) on the basis of the image formation number designated by the single job (i.e., the continuous image formation number) are used. Further, in the case where the photosensitive drum 1 is driven, the traveling distance of the photosensitive drum 1 is counted. Further, the continuous image formation number is counted every image formation in the single job. Then, in the case where during an arbitrary job, the count value of the traveling distance of the photosensitive drum 1 reaches the first threshold, the supplying operation is executed. Further, boot the count value of the traveling distance of the photosensitive drum 1 and the count value of the continuous image formation number are reset to initial values. Further, also in the case where during the arbitrary job, the count value of the continuous image formation number reaches the second threshold before the count value of the traveling distance of the photosensitive drum 1 reaches the first threshold, the supplying operation is executed. Then, both the count value of the traveling distance of the photosensitive drum 1 and the count value of the continuous image formation number are reset to the initial values.

The first threshold on the basis of the traveling distance and the second threshold on the basis of the continuous image formation number are set in the following manner. That is, in the case where a job in which a designated image formation number is a first value or less is repeated from a state in which both the traveling distance and the continuous image formation number are the initial values is repeated, during execution of an arbitrary job, the count value of the traveling distance is caused to reach the first threshold early. Further, in the case where a job in which the designated image formation number is the first value or less and a second value or more from both the traveling distance and the continuous image formation number are the initial values is executed, during the execution of the job, the count value the continuous image formation number is caused to reach the second threshold early.

In other words, in the case where a job in which a designated image formation number is a first value or less is repeated, a cumulative image formation number when the count value of the traveling distance reaches the first threshold is made smaller than the second threshold. Further, in the case where a job in which the designated image formation number is the first value or less and a second value or more is executed, the count value of the traveling distance when the count value the continuous image formation number reaches the second threshold is made smaller than the first threshold.

That is, in many cases where it is assumed that a job in which the designated image formation number is the first value (for example, 400 toner images) or less is repeated, on the basis of the cumulative traveling distance of the photosensitive drum 1, the supplying operation is executed at a frequency sufficient to maintain the sliding property and to suppress the paper powder deposition. As a result, the supplying operation can be executed efficiently, so that unnecessary consumption of the toner and lowering in lifetimes of the members such as the photosensitive drum 1, the intermediary transfer belt 7, the first and second blades 6*a* and 74*a*, the charging roller 2 and the like. Further, when a job in which the designated image formation number is the second value (for example, 500 toner images) or more is executed, even in the case where the cumulative traveling distance of the photosensitive drum 1 does not reach the first threshold, on the basis of the continuous image formation number in the job, the supplying operation is executed at a sufficient frequency with reliability. As a result, it is possible to suppress the improper cleaning resulting from the paper powder deposition which is liable to become problematic by continuous sending of the paper powder to the cleaning position during the continuous image formation. Further, in other words, in this embodiment, the second threshold is set as an upper limit value of the continuous image formation number in the single job while the supplying operation is executed in principle in the case where the count value of the traveling distance reaches the first threshold. Then, in the case where the continuous image formation number reaches the second threshold as the upper limit value during execution of the single job, even when the count value of the traveling distance does not reach the first threshold, the supplying operation is executed.

Further, also in the case where the supplying operation is executed on the basis of either of the traveling distance and the continuous image formation number, both the count of the traveling distance of the photosensitive drum 1 and the count value of the continuous image formation number are reset to the initial values. As a result, unnecessary redundancy of the supplying operations is prevented, so that the unnecessary toner consumption and the lifetime lowerings of the members can be suppressed.

Thus, according to this embodiment, the improper cleaning resulting from the paper powder deposition during the continuous image formation can be suppressed while suppressing the unnecessary toner consumption and the lifetime lowerings of the members. Accordingly, it becomes possible to maintain a good cleaning performance for a long term.

6. Control of Supplying Operation

Next, control of the supplying operation in this embodiment will be described.

With reference to FIG. 3, in this embodiment, properness discrimination of the supplying operation and control of a procedure of the supplying operation are carried out by the controller 50. To the controller 50, as counting means, the first counter (traveling distance counter) 61 and the second counter (continuous image formation number counter) 62 are connected. When the respective photosensitive drums 1 (1Y, 1M, 1C, 1K) are driven, the controller 50 counts the traveling distances of the photosensitive drums 1 and causes the first counter 61 as a storing portion to sequentially renew and store the traveling distances. Incidentally, in this embodiment, the traveling distance of each of the photosensitive drums 1 corresponds to a value obtained by multiplying substantially all the toner images of rotation of the photosensitive drum 1 by a process speed. As described later, a count value (counted value) of the traveling distance of each of the photosensitive drums 1 by the first counter 61 is reset to an initial value (0 in this embodiment) when the supplying operation in which the toner band is formed on the associated photosensitive drum 1 is executed. Further, the controller 50 counts the continuous image formation number every formation of the image in the single job and causes the second counter 62 as a storing portion to sequentially renew and store the continuous image formation numbers. As described later, a count value (counted value) of the continuous image formation number by the second counter 62 is reset to an initial value (0 in this embodiment) when the supplying operation in which the toner band is formed on either of the photosensitive drum 1*s* is executed or the job ends. Incidentally, the first counter 61 is capable of counting, as information on the traveling distance, arbitrary information indicating the traveling distance such as a rotation toner image (traveling toner image, driving toner image). Similarly, the second counter 62 is capable of counting, as information on the continuous image formation number, arbitrary information indicating the continuous image formation number.

In this embodiment, the supplying operation is executed in, as a non-image-forming period, the post-rotation step or the sheet interval step. FIG. 8 is a flowchart showing an outline of a procedure in which whether or not formation of a last image is carried out is discriminated and control is switched. When the job is started, the controller 50 discriminates whether or not a subsequent image to be formed is a last image in the job (S101). In the case where the controller 50 discriminated in S101 that the subsequent image is the last image ("YES"), the controller 50 causes the process to go to a procedure shown in FIG. 1 (S102). Further, in the case where the controller 50 discriminated in S101 that the subsequent image is not the last image ("NO"), the controller 50 causes the process to go to a procedure shown in FIG. 10 (S103). In the following, a procedure of the case where the supplying operation is executed in the post-rotation step and a procedure of the case where the supplying operation is executed in the sheet interval step will be successively described.

Here, in this embodiment, a first threshold DRL on the basis of the traveling distance of the photosensitive drum 1 is set at 130,000 mm roughly corresponding to the traveling distance of the photosensitive drum 1 in the case where continuous image formation of A4-size sheets (short edge feeding) is carried out 500 toner images. Further, in this embodiment, a second threshold RGC on the basis of the continuous image formation number is set at 400 toner images for the A4-size sheets (short edge feeding).

FIG. 9 is a flowchart showing an outline of the procedure of the case where the supplying operation is executed in the post-rotation step.

The controller 50 causes the image forming apparatus to start image formation (S201). The controller 50 calculates the traveling distance of each of the photosensitive drums 1 after the image formation and causes the first counter 61 to store the traveling distance in an integrated manner and causes the second counter 62 to store the continuous image formation number in an integrated manner (S202). Then, the controller 50 discriminates the presence or absence of the image forming portions S in which a count value LT of the traveling distance of the photosensitive drum 1 by the first counter 61 is not less than the first threshold DRL on the basis of the traveling distance of the photosensitive drum 1 (i.e., LT≥DRL) (S203). In the case where the controller 50 discriminated in S203 that the image forming portion S satisfying LT≥DRL is present ("YES"), the controller 50 determines that the toner band is formed by the image forming portion S satisfying LT DRL (S204). Then, the controller 50 causes the image forming portion S determined in S204 to form the toner band on the photosensitive drum 1 in the post-rotation step and causes a toner supply executing portion to execute the supplying operation in which the toner band is formed on the photosensitive drum 1 by the image forming portion S determined in S024 and then is transferred onto the intermediary transfer belt 7 is executed in the post-rotation step (S205). As a result, a part of the toner band (band toner) is supplied to the first cleaning position Cd of the image forming portion S and another part of the toner band is supplied to the second cleaning position Cb of the image forming portion S. Thereafter, the controller 50 resets the count value LT, by the first counter 61, of the traveling distance of the photosensitive drum 1 of the image forming portion S in which the toner band is formed and a count value GT of the continuous image formation number by the second counter 62 to initial values, respectively (S206). Then, the controller 50 stops the operation of the image forming apparatus 100 (S207).

Further, in the case where the controller 50 discriminated in S203 that the image forming portion satisfying LT≥DRL is absent ("NO"), the controller 50 discriminates whether or not the count value GT of the continuous image formation number in the job is not less than a second threshold RGC (i.e., GT≥RGC) (S208). In the case where the controller 50 discriminated in S208 that GT≥RGC is satisfied ("YES"), the controller 50 determines that the toner band is formed by the image forming portion SK for black (S209). Then, the controller 50 causes the image forming portion SK for black to form the toner band on the photosensitive drum 1K in the post-rotation step and causes a toner supply executing portion to execute the supplying operation in which the toner band is formed on the photosensitive drum 1K by the image forming portion SK for black and then is transferred onto the intermediary transfer belt 7 is executed in the post-rotation step (S210). As a result, a part of the toner band (band toner) is supplied to the first cleaning position Cd of the image forming portion SK for black and another part of the toner band is supplied to the second cleaning position Cb of the image forming portion S. Thereafter, the controller 50 resets the count value LT, by the first counter 61, of the traveling distance of the photosensitive drum 1K of the image forming portion SK for black and the count value GT of the continuous image formation number by the second counter 62 to initial values, respectively (S211). Then, the controller 50 stops the operation of the image forming apparatus 100 (S207).

Further, in the case where the controller 50 discriminated in S208 that GT<RGC is satisfied ("NO"), the controller 50 resets the count value GT of the continuous image formation number by the second counter 62 to the initial value (S212), and stops the operation of the image forming apparatus 100 (S207).

FIG. 10 is a flowchart showing an outline of the procedure of the case where the supplying operation is executed in the sheet interval step.

The controller 50 causes the image forming apparatus to start image formation (S301), and when the image formation is ended, the controller 50 discriminates whether or not timing is execution timing of the control operation such as the image density adjusting operation or the registration adjusting operation (S302). In the case where the controller 50 discriminated in S302 that the timing is not the execution timing of the control operation, the controller 50 causes the process to go to S304 as it is, and in the case where the controller 50 discriminated in S302 that the timing is the execution timing of the control operation, after the control operation is executed (S303), the controller 50 causes the process to go to S304. The controller 50 calculates the traveling distance of each of the photosensitive drums 1 after the image formation or after the image formation and an end of the control operation, and causes the first counter 61 to store the traveling distance in an integrated manner and causes the second counter 62 to store the continuous image formation number in an integrated manner (S304). Then, the controller 50 discriminates the presence or absence of the image forming portions S in which a count value LT of the traveling distance of the photosensitive drum 1 by the first counter 61 is not less than the first threshold DRL on the basis of the traveling distance of the photosensitive drum 1 (i.e., LT≥DRL) (S305). In the case where the controller 50 discriminated in S305 that the image forming portion S satisfying LT≥DRL is present ("YES"), the controller 50 determines that the toner band is formed by the image forming portion S satisfying LT DRL (S306). Then, the controller 50 causes the image forming portion S determined in S306 to form the toner band on the photosensitive drum 1 in the sheet interval step and causes a toner supply executing portion to execute the supplying operation in which the toner band is formed on the photosensitive drum 1 by the image forming portion S determined in S024 and then is transferred onto the intermediary transfer belt 7 is executed in the post-rotation step (S307). Thereafter, the controller 50 resets the count value LT, by the first counter 61, of the traveling distance of the photosensitive drum 1 of the image forming portion S in which the toner band is formed and a count value GT of the continuous image formation number by the second counter 62 to initial values, respectively (S308). Then, the controller 50 causes the process to go back to S101 of FIG. 8.

Further, in the case where the controller 50 discriminated in S305 that the image forming portion satisfying LT≥DRL is absent ("NO"), the controller 50 discriminates whether or not the count value GT of the continuous image formation number in the job is not less than a second threshold RGC (i.e., GT≥RGC) (S309). In the case where the controller 50 discriminated in S309 that GT≥RGC is satisfied ("YES"), the controller 50 determines that the toner band is formed by the image forming portion SK for black (S310). Then, the controller 50 causes the image forming portion SK for black to form the toner band on the photosensitive drum 1K in the sheet interval step and causes a toner supply executing portion to execute the supplying operation in which the toner band is formed on the photosensitive drum 1K by the image forming portion SK for black and then is transferred onto the intermediary transfer belt 7 is executed in the post-rotation step (S311). Thereafter, the controller 50 resets the count value LT, by the first counter 61, of the traveling distance of the photosensitive drum 1K of the image forming portion SK for black and the count value GT of the continuous image formation number by the second counter 62 to initial values, respectively (S312). Then, the controller 50 causes the process to go back to S101 of FIG. 8.

Further, in the case where the controller 50 discriminated in S309 that GT<RGC is satisfied ("NO"), the controller 50 causes the process to go back to S101 of FIG. 8.

Incidentally, in this embodiment, the toner band formed on the basis of the continuous image formation number is the toner band of black (single color), so that a reduction in toner consumption amount was realized. However, this toner band is not limited to the toner band of black, but may also be a toner band of another color. Further, on assumption that a use frequency of, for example, paper powder stress paper (described later) is high, the toner band may also be used the toners of a plurality of colors.

7. Effect

FIG. 11 is a graph showing a relationship between the image formation number designated in the single job (i.e., the continuous image formation number) and the execution interval of the supplying operation in the case where a durability test in which the job is repetitively executed was conducted in this embodiment and a comparison example. In FIG. 11, the abscissa represents the image formation number designated in the single job (i.e., the continuous image formation number), and the ordinate represents the execution interval (cumulative image formation number from last execution to current execution) of the supplying operation. Further, a region indicated by a broken line represents a region where there is a possibility of occurrence of the improper cleaning resulting from the deposition of the paper powder at the second cleaning position Cb.

In this embodiment, as described above, the first threshold DRL on the basis of the traveling distance of the photosensitive drum 1 is set at 130,000 mm roughly corresponding to the traveling distance of the photosensitive drum 1 in the case where the continuous image formation of the A4-size sheets (short edge feeding) is carried out 500 toner images. Further, in this embodiment, the second threshold RGC on the basis of the continuous image formation number is set at 400 toner images for the A4-size sheets (short edge feeding). On the other hand, in the comparison example, the supplying operation is executed on the basis of only the traveling distance of the photosensitive drum 1 similar to the traveling distance of the photosensitive drum 1 in this embodiment. Further, in the constitution of this embodiment (also in the comparison example), when the continuous image formation number roughly for the A4-size sheets exceeds 500 thresholds, there is a possibility that the improper cleaning resulting from the paper powder deposition at the second cleaning position Cb occurs.

As shown in FIG. 11, in the case where a job in which the designated image formation number is relatively small, for example, 400 toner images or less, in both of this embodiment and the comparison example, the supplying operation is executed on the basis of the first threshold DRL. Further, an execution interval (cumulative image formation number between consecution supplying operations) of the supplying operation in this case is smaller than 400 toner images which is the second threshold. This is because the traveling distance of the photosensitive drum 1 is roughly larger in the case where the job in which the designated image formation number is relatively small is regulated than in the case where the job in which the designated image formation number is relatively large is repeated.

On the other hand, as shown in FIG. 11, in the case where a job in which the designated image formation number is, for example, 500 toner images or more is repeated, behavior varies between this embodiment and the comparison example.

First, in this embodiment, even in the case where the supplying operation is not executed on the basis of the first threshold DRL during execution of the job, at a point of a toner image when the continuous image formation number reaches 400 toner images, the supplying operation is forcedly executed on the basis of the second threshold RGC. As a result, in this embodiment, in the case where the job with the designate image formation number of 500 toner images or more is executed, the supplying operation is always executed at least once during the execution of the job. Accordingly, it is possible to suppress the improper cleaning resulting from the paper powder deposition which is liable to occur when the continuous image formation number exceeds 500 toner images.

On the other hand, in the comparison example, the supplying operation is executed on the basis of only the first threshold DRL based on the traveling distance of the photosensitive drum 1. This first threshold is set at the traveling distance corresponding to 50 toner images of the continuous image formation. For that reason, in the case where the job with the designated image formation number of 500 toner images or more is executed, the supplying operation is executed at a point of a toner image when the traveling distance of the photosensitive drum 1 reaches the traveling distance corresponding to 500 toner images of the continuous image formation. Thus, when the supplying operation is executed, roughly, the improper cleaning resulting from the paper powder deposition at the second cleaning position Cb can be suppressed. However, for example, in the case where during the execution of the job, the control operation (such as the image density adjusting operation or the registration adjusting operation) other than the supplying operation is executed, the traveling distance of the photosensitive drum 1 exceeds the traveling distance of the photosensitive drum 1 corresponding to 500 toner images of the continuous image formation during the execution of the job in some instances. That is, the control operation other than the supplying operation is executed at predetermined timing set independently of the execution timing of the supplying operation. Further, in general, the timing when the control operation is executed is not constant depending on an environment of the image forming apparatus 100 and a condition of the image formed. For that reason, in the case where the execution timing of the control operation other than the supplying operation arrives immediately before, for example, the traveling distance reaches the first threshold DRL or in the like case, the traveling distance exceeds the first threshold DRL in some instances by executing the control operation. Thus, in the comparison example, in the case where the job with the designated image formation number of 500 toner images or more is executed, the supplying operation is not executed in some instances even when the continuous image formation number exceeds 500 toner images where the improper cleaning resulting from the paper powder deposition at the second cleaning position Cb. As a result, in the comparison example, the execution interval of the supplying operation enters the region indicated by the broken line in FIG. 11, so that the improper cleaning resulting from the paper powder deposition at the second cleaning position Cb cannot be suppressed.

FIG. 12 is a graph showing a result that a relationship between an amount of the deposition of the paper powder at the second cleaning position Cb and the cumulative image formation number was checked by repeating the job with the continuous image formation number of 500 toner images. At test environment was a room temperature environment, and an image ratio of the image formed in the job was 5%. In FIG. 12, the abscissa represents the cumulative image formation number, and the ordinate represents the amount of deposition of the paper powder. The paper powder deposition amount is represented by a measured value of a height (with respect to a direction normal to the intermediary transfer belt 7) of the paper powder deposited on the intermediary transfer belt 7 in the neighborhood of the edge portion of the second blade 74*a*. According to study by the present inventor, in the constitution of this embodiment (also in the constitution of the comparison example), when the paper powder deposition amount (height) exceeds 20 the toner slips through the second cleaning position Cb, and thus improper cleaning occurred in some instances.

In this embodiment, in either of the case where surface roughness of the intermediary transfer belt 7 is a maximum of a tolerance (part (a) in FIG. 12) and the case where the surface roughness of the intermediary transfer belt 7 is a minimum of the tolerance (part (b) of FIG. 12), even when the cumulative image formation number is 10,000 toner images or more, the paper powder deposition amount did not exceed 20 Further, until the image formation number reaches 30,000 toner images, a good cleaning performance was stably obtained at both of the first and second cleaning positions Cd and Cb.

On the other hand, in the change (in the case where the surface roughness of the intermediary transfer belt 7 is the minimum of the tolerance), at point of toner images of 1,000-10,000 toner images in image formation number, the paper powder deposition amount exceeded 20 μm and reached 30 μm. Further, at the second cleaning position Cb, occurrence that the toner slips through the cleaning blade was confirmed.

As described above, according to this embodiment, the supplying operation is efficiently executed on the basis of the traveling distance, so that not only the unnecessary toner consumption and the lifetime lowerings of the members can be suppressed but also the improper cleaning resulting from the paper powder deposition during the continuous image formation can be suppressed.

Embodiment 2

Next, another embodiment of the present invention will be described. Basic constitution and operation of an image forming apparatus in this embodiment are the same as those of the image forming apparatus in Embodiment 1. Accordingly, in the image forming apparatus in this embodiment, elements having functions or constitutions identical or corresponding to those of the image forming apparatus of Embodiment 1 are represented by the same reference numerals or symbols and will be omitted from detailed description.

In this embodiment, in the case where either of the count values of the traveling distances of the photosensitive drums 1Y, 1M and 1C for yellow, magenta and cyan reaches the first threshold DRC, the toner band is formed on these three photosensitive drums 1Y, 1M and 1C in synchronism with each other.

Also, in this embodiment, similarly as in Embodiment 1, the supplying operation is executed in, as the non-image-forming period, the post-rotation step or the sheet interval step, and in accordance with a procedure similar to the procedure of FIG. 8 in Embodiment 1, switching of control depending on whether or not a last image in a job is formed is carried out.

FIG. 13 is a flowchart showing an outline of the procedure of the case where the supplying operation is executed in the post-rotation step in this embodiment. In FIG. 13, a process which is the same as the procedure (process) of FIG. 9 in Embodiment 1 is described by adding the same stop numbers and will be omitted from detailed description.

In this embodiment, in the case where the controller 50 discriminated in S203 that the image forming portion S satisfying LT≥DRL is present ("YES"), the controller 50 discriminates whether or not the image forming portion S satisfying LT DRL is which one of the image forming portions SY, SM and SC (S213). In the case where the controller 50 discriminated in S213 that the image forming portion S satisfying LT≥DRL is one of the image forming portions SY, SM and SC ("YES"), the controller 50 determines that the toner band is formed on the photosensitive drums 1Y, 1M and 1C of the image forming portions SY, SM and SC (S214). Then, the controller 50 causes the image forming portions SY, SM and SC to form the toner bands on the photosensitive drums 1Y, 1M and 1C in the post-rotation step and causes the toner supply executing portion to execute the supplying operation in which the toner bands are formed on the photosensitive drums 1Y, 1M and 1C by the image forming portions SY, SM and SC and then are transferred onto the intermediary transfer belt 7 is executed in the post-rotation step (S215). Incidentally, in the case where the toner bands are formed by the plurality of image forming portions S in the supplying operation, the respective color toner bands may be transferred superposedly onto the intermediary transfer belt 7 or may also be successively transferred along a traveling direction of the intermediary transfer belt 7. Thereafter, the controller 50 resets the count value LT, by the first counter 61, of the traveling distance of each of the photosensitive drums 1Y, 1M and 1C of the image forming portions SY, SM and SC in which the toner bands are formed and a count value GT of the continuous image formation number by the second counter 62 to initial values, respectively (S216).

Further, in the case where the controller 50 discriminated in S213 that the image forming portion S satisfying LT≥DRL is not one of the image forming portions SY, SM and SC ("NO"), the controller 50 determines that the toner band is formed by the image forming portion SK for black (S217). Then, the controller 50 causes the image forming portion SK for black to form the toner band on the photosensitive drum 1K in the post-rotation step and causes a toner supply executing portion to execute the supplying operation in which the toner band is formed on the photosensitive drum 1K by the image forming portion SK for black and then is transferred onto the intermediary transfer belt 7 is executed in the post-rotation step (S218). Thereafter, the controller 50 resets the count value LT, by the first counter 61, of the traveling distance of the photosensitive drum 1K of the image forming portion SK for black and the count value GT of the continuous image formation number by the second counter 62 to initial values, respectively (S219).

Incidentally, although illustration is omitted from FIG. 13, in the case where the controller 50 discriminated in S213 that the image forming portion S satisfying LT≥DRL is all of the image forming portions SY, SM, SC and SK for Y, M, C and K, the supplying operation for forming the toner bands by all of the image forming portions SY, SM, SC and Sk may only be required to be executed. Further, in this case, after the supplying operation is executed, the count values of the traveling distances of the photosensitive drums 1 of all of the image forming portions SY, SM, SC and SK may only be required to be reset to initial values.

FIG. 14 is a flowchart showing an outline of the procedure of the case where the supplying operation is executed in the sheet interval step in this embodiment. In FIG. 14, a process which is the same as the procedure (process) of FIG. 10 in Embodiment 1 is described by adding the same stop numbers and will be omitted from detailed description.

In this embodiment, in the case where the controller 50 discriminated in S305 that the image forming portion S satisfying LT≥DRL is present ("YES"), the controller 50 discriminates whether or not the image forming portion S satisfying LT DRL is which one of the image forming portions SY, SM and SC (S313). Then, on the basis of a discrimination result of S313, the controller 50 executes the processes S314 to S319 which are similar to the processes S214 to S219 of FIG. 13 in the case where the supplying operation is executed in the post-rotation step. Incidentally, also an operation in the case where the controller 50 discriminated in S313 that the image forming portion S satisfying LT≥DRL is all of the image forming portions SY, SM, SC and SK for Y, M, C and K may only be required to be executed similarly as in the case where the supplying operation is executed in the above-described post-rotation step.

As described above, according to this embodiment, the toner band operations of formation by the plurality of image forming portions for which the number of toner images of operations are easily approximated and synchronized with each other, so that compared with Embodiment 1, unnecessary idling of the photosensitive drum 1 and the intermediary transfer belt 7 is reduced and thus the lifetime lowerings of the members can be suppressed.

Incidentally, in this embodiment, of a plurality of (four) image forming portions, the image forming portions SY, SM and SC for the respective colors of yellow, magenta and cyan in which operations of the toner band formation are carried out in a synchronized manner are an example of specific image forming portions. Further, in this embodiment, of the plurality of (four) image forming portions, the image forming portion Sk for black is an example of at least one another image forming portion other than the specific image forming portions. The specific image forming portions are not limited to those described above in this embodiment, but the number thereof is not limited to three. The number thereof may also be two or not less than four. Further, another image forming portion other than the specific image forming portions is not limited to the image forming portion for black in this embodiment, but the number thereof is not limited to one. The number thereof may also be two or more.

Embodiment 3

Next, another embodiment of the present invention will be described. Basic constitution and operation of an image forming apparatus in this embodiment are the same as those of the image forming apparatus in Embodiment 1. Accordingly, in the image forming apparatus in this embodiment, elements having functions or constitutions identical or corresponding to those of the image forming apparatus of Embodiment 1 are represented by the same reference numerals or symbols and will be omitted from detailed description.

In this embodiment, on the basis of information on the kind of the recording material P on which the image is to be formed, whether the supplying operation should be executed on the basis of both of the first and second thresholds or on the basis of only the first threshold of the first and second thresholds is changed.

Referring to FIG. 3, in this embodiment, the information on the kind of the recording material P used for image formation is inputted by an operator from the operation portion 120 of the apparatus main assembly or form an external device connected to the controller 50 through the communicating portion 140. Here, the kind of the recording material P includes attributes such as plain paper, thick paper and glossy paper and arbitrary information, such as a maker, a brand or a product number, capable of distinguishing the recording material P. In this embodiment, particularly, the recording material P used for image formation may only be identified whether or not the recording material P is a recording material P in which an additive is added in a relatively large amount and thus a depositing amount or generation amount of the paper powder is relatively large and has a relatively large influence on the paper powder deposition (herein, this recording material P is referred to as "paper powder stress paper"). The information on the kind of the recording material P inputted from the operating portion 120 or the external device is transmitted to the controller 50 and is stored, in the memory 52, as data identifying (specifying) the kind of the recording material P used for image formation. For example, in a procedure in which the kind of the recording material P used for image formation is designated (selected) through the operating portion 120 or the external device, whether or not the recording material P is the paper powder stress paper can be made designatable (selectable). Further, for example, information for associating the kind of the recording material P and the information on whether or not the recording material P is the paper powder stress paper with each other is stored in the memory 52 in advance the controller 50 may also be caused to be capable of identifying whether or not the recording material P designated through the operating portion 120 or the external device. In this embodiment, a kind detecting means for detecting (identifying) the kind of the recording material P is constituted by the operating portion, the communicating portion 140 and the controller 50.

Also, in this embodiment, similarly as in Embodiment 1, the supplying operation is executed in, as the non-image-forming period, the post-rotation step or the sheet interval step, and in accordance with a procedure similar to the procedure of FIG. 8 in Embodiment 1, switching of control depending on whether or not a last image in a job is formed is carried out.

FIG. 15 is a flowchart showing an outline of the procedure of the case where the supplying operation is executed in the post-rotation step in this embodiment. In FIG. 15, a process which is the same as the procedure (process) of FIG. 9 in Embodiment 1 is described by adding the same stop numbers and will be omitted from detailed description.

In this embodiment, in the case where the controller 50 discriminated in S203 that the image forming portion S satisfying LT≥DRL is absent ("NO"), on the basis of the data, stored in the memory 52, for identifying the kind of the recording material P, the controller 50 discriminates whether or not the recording material P is the paper powder stress paper (S220). Then, in the case where the controller 50 discriminated in S220 that the recording material P is the paper powder stress paper ("YES"), the controller 50 carries out the procedure of S208 to S211, in which the properness discrimination of the supplying operation based on the second threshold RGC and the supplying operation and the like are carried out, similarly as in Embodiment 1. Further, in the case where the controller 50 discriminated in S220 that the recording material P is not the paper powder stress paper ("NO"), the controller 50 resets the count value GT of the continuous image formation number to the initial value (S212) and then stops the operation of the image forming apparatus 100 without via the properness discrimination of the supplying operation based on the second threshold RGC and the like operation (S207).

FIG. 16 is a flowchart showing an outline of the procedure of the case where the supplying operation is executed in the sheet interval step in this embodiment. In FIG. 16, a process which is the same as the procedure (process) of FIG. 9 in Embodiment 1 is described by adding the same stop numbers and will be omitted from detailed description.

In this embodiment, in the case where the controller 50 discriminated in S305 that the image forming portion S satisfying LT≥DRL is absent ("NO"), on the basis of the data, stored in the memory 52, for identifying the kind of the recording material P, the controller 50 discriminates whether or not the recording material P is the paper powder stress paper (S320). Then, in the case where the controller 50 discriminated in S320 that the recording material P is the paper powder stress paper ("YES"), the controller 50 carries out the procedure of S309 to S312, in which the properness discrimination of the supplying operation based on the second threshold RGC and the supplying operation and the like are carried out, similarly as in Embodiment 1. Further, in the case where the controller 50 discriminated in S320 that the recording material P is not the paper powder stress paper ("NO"), the controller 50 causes the process to go back to S101 of FIG. 8 without via the properness discrimination of the supplying operation based on the second threshold RGC and the like operation.

As described above, in this embodiment, only in the case where the recording material P used for image formation is the paper powder stress paper, the supplying operation is executed on the basis of both the traveling distance and the continuous image formation number, and in the case where the recording material P is not the paper powder stress paper, the supplying operation is executed on the basis of only the traveling distance. As a result, the supplying operation can be efficiently executed depending on the kind of the recording material P used for image formation. Consequently, compared with Embodiment 1, the unnecessary toner consumption and the lifetime lowerings of the members can be suppressed.

Incidentally, in this embodiment, depending on whether or not the recording material P used for image formation is the paper powder stress paper, execution or non-execution of the control of the supplying operation on the basis of the continuous image formation number was switched. However, the present invention is not limited thereto, but the kind of the recording material P is further finely divided into a plurality of kinds of the recording materials P depending on a degree of the influence of the kind of the recording material P on the paper powder deposition and a plurality of second thresholds different from each other are assigned to the kinds of the recording materials P (paper powder stress papers). That is, in place of or in addition to the change in use or non-use of the second threshold as in this embodiment, the second threshold can be changed on the basis of the information on the kind of the recording material P used for image formation. For example, two second thresholds RGC different from each other are set for a first kind of paper powder stress paper and a second kind of paper powder stress paper having a larger influence on the paper powder deposition than the first kind of the paper powder stress paper. In this case, the second threshold RGC for the second kind of the paper powder stress paper is set at a value (continuous image formation number) smaller than a value of the second threshold RGC for the first kind of the paper powder stress paper. As a result, even in the case where the paper powder stress paper having the relatively large influence on the paper powder deposition is used, the supplying operation can be forcedly executed on the basis of the continuous image formation number before the paper powder deposition progresses to the extent exceeding a tolerable range. For that reason, even in the case where the paper powder stress paper having the relatively large influence on the paper powder deposition is used, the improper cleaning resulting from the paper powder deposition can be suppressed.

Further, in this embodiment, the switching of the control depending on the kind of the recording material P is combined with the control similar to the control in Embodiment 1, but may also be combined with the control similar to the control in Embodiment 2.

Embodiment 4

Next, another embodiment of the present invention will be described. Basic constitution and operation of an image forming apparatus in this embodiment are the same as those of the image forming apparatus in Embodiment 1. Accordingly, in the image forming apparatus in this embodiment, elements having functions or constitutions identical or corresponding to those of the image forming apparatus of Embodiment 1 are represented by the same reference numerals or symbols and will be omitted from detailed description.

1. Outline of this Embodiment

This embodiment is different from Embodiments 1 to 3 in an integrating method of the traveling distance and a setting method of the first threshold DRL based on the traveling distance. In this embodiment, a degree of lowering in sliding property between the image bearing member and the cleaning blade is estimated in conformity with an actual status (state), and on the basis of a result thereof, execution timing of the supplying operation can be controlled.

Specifically, in this embodiment, the traveling distance is integrated using, as parameters, an idling toner image (no toner idling toner image) and a charging idling toner image which are described later. Then, correspondingly to an integrated value of the traveling distance, the first threshold DRL is set so that the sliding property can be sufficiently maintained. As a result, a factor of the idling toner image in a state in which the toner exists on the image bearing member can be removed from the idling toner image or can be added to the idling toner image in a weighting manner. Accordingly, the supplying operation can be further efficiently executed, so that the unnecessary toner consumption and the lifetime lowerings of the members can be further suppressed.

2. Parameters Relating to Traveling Distance

Definitions of parameters used for calculating the traveling distance in this embodiment will be described.

Drum Driving Toner Image: ΔDRt (Sec, Detection Unit; 0.1 Sec)

The drum driving toner image ΔDRt is a toner image in which the photosensitive drum 1 rotated. The drum driving toner image ΔDRt is calculated every image formation or every control operation (such as the image density adjusting operation or the registration adjusting operation). The drum driving toner image ΔDRt includes all the toner images in which the photosensitive drum 1 is rotated.

Development Driving Toner Image: ΔVRt (Sec, Detection Unit; 0.1 Sec)

The development driving toner image ΔVRt is a toner image in which the developing sleeve 4*b* is rotated. In this embodiment, in synchronism with the rotation of the developing sleeve 4*b*, a developing voltage is applied to the developing sleeve 4*b*. The development driving toner image ΔVRt is calculated every image formation or every control operation. The drum driving toner image ΔDVt includes all the toner images in which the developing sleeve 4 is rotated.

Charging Toner Image: ΔCt (Sec, Detection Unit; 0.1 Sec)

The charging toner image ΔCt is a toner image in which a charging voltage is applied to the charging roller 2. The charging toner image ΔCt is calculated every image formation or every control operation. The charging toner image ΔCt includes all the toner images in which the charging voltage is applied to the charging roller 2.

Idling Toner Image: ΔDKt (Sec, Detection Unit: 0.1 Sec)

The idling toner image ΔDKt is a toner image (no toner idling toner image) in which the photosensitive drum 1 rotated in a state in which rotational drive of the developing sleeve 4*b* was OFF and in which application of the charging voltage to the charging roller 2 was OFF. The idling toner image ΔDKt is calculated every image formation or every control operation. The idling toner image ΔDKt is calculated by the following formula (1):

$$\Delta DKt = \Delta DRt - \Delta Ct \quad (1).$$

Incidentally, when this idling toner image is multiplied by the process speed, an idling traveling distance (no toner idling traveling distance) which is a traveling distance of the photosensitive drum 1 in the idling toner image is acquired.

Charging Idling Toner Image: ΔCKt (Sec, Detection Unit: 0.1 Sec)

The charging idling toner image ΔCKt is a toner image in which the photosensitive drum 1 rotated in a state in which rotational drive of the developing sleeve 4*b* was OFF and in which application of the charging voltage to the charging roller 2 was ON. The charging idling toner image ΔCKt is calculated every image formation or every control operation. The charging idling toner image ΔCKt is calculated by the following formula (2):

$$\Delta CKt=\Delta Ct-\Delta DVt \quad (2).$$

Incidentally, when this charging idling toner image is multiplied by the process speed, a charging idling traveling distance which is a traveling distance of the photosensitive drum 1 in the charging idling toner image is acquired.

3. Calculation of Traveling Distance

In this embodiment, a traveling distance ΔLT of the photosensitive drum 1 is calculated by the following formula (3) by using the above-described parameters. This traveling distance ΔLT of the photosensitive drum 1 corresponds to a sum of traveling distances of the photosensitive drum 1 in a state in which the toner does not exist on the photosensitive drum 1 (i.e., total no-toner traveling distance).

$$\Delta LT=(\alpha\times\Delta DKt+\Delta CKt)\times(\text{process speed}) \quad (3)$$

In this embodiment, a traveling distance component of the photosensitive drum 1 in a state in which the application of the charging voltage to the charging roller 2 is OFF is subjected to weighting by being multiplied by a preset coefficient α. Then, in this embodiment, the traveling distance (total no-toner traveling distance) of the photosensitive drum 1 is calculated every image formation or every control operation. Specifically, the controller 50 calculates the traveling distance and causes the first counter 61 as the storing portion to store the calculated traveling distance. Thus, the traveling distance of the photosensitive drum 1 can be integrated using, as parameters, at least one (both in this embodiment) of the following pieces of information). A first piece of information is a traveling distance in a state in which the toner is not supplied to the photosensitive drum 1 and in which the photosensitive drum 1 is not charged. A second piece of information is a traveling distance of the photosensitive drum 1 in a state in which the toner is not supplied to the photosensitive drum 1 and in which the photosensitive drum 1 is charged. Further, on the basis of a relationship between the traveling distance (total no toner traveling distance) ΔLT and a degree of a lowering in sliding property between the photosensitive drum 1 and the first blade 6*a*, the first threshold DRL is set in advance so that the sliding property can be sufficiently maintained.

Thus, the traveling distance can be integrated by using, as parameters, the pieces of information on various factors relating to the degree of the lowering in sliding property between the image bearing member and the cleaning blade. The parameters includes those in this embodiment and for example includes the following pieces of information. The information is information on the idling traveling distance of the photosensitive drum 1, the charging idling traveling distance of the photosensitive drum 1, the traveling distance in a state in which the charging and the development on the photosensitive drum 1 are carried out, and the like. Further, the degree of the lowering in sliding property between the image bearing member and the cleaning blade also varies depending on a condition of the image formation. For that reason, it is also possible to use pieces of information on the toner amount of the image to be formed, such as an image pattern (image ratio or the like), an image forming mode (high quality mode, low quality mode or the like) and the like. These parameters can be used in arbitrary combination. For example, not only the traveling distance in a non-image-forming period can be integrated using, as the parameter, the information on the idling traveling distance similarly as in this embodiment, but also the traveling distance in an image forming period can be integrated using, as the parameter, the input on the above-described toner amount.

As described above, according to this embodiment, compared with Embodiments 1 to 3, the supplying operation based on the traveling distance can be executed at necessary timing depending on the actual status with reliability.

Other Embodiment

In the above, the present invention was described based on specific embodiments but is not limited to the above-described embodiments.

In the above-described embodiments, the supplying operations for supplying the toner to be cleaning position of the photosensitive member and the cleaning position of the intermediary transfer member in the image forming apparatus of the intermediary transfer type were described. Similarly, the present invention is also applicable to an image forming apparatus of a direct transfer type. The image forming apparatus of the direct transfer type includes, in place of the intermediary transfer member in the above-described embodiments, a recording material carrying member which is a transfer belt constituted by, for example, an endless belt. Further, as is well known in the art, in the image forming apparatus of the direct transfer type, similarly as formation of the toner images on the intermediary transfer member in the above-described embodiments, the toner image is formed on the recording material carried out conveyed by the recording material carrying member. The recording material carrying member is an example of the second image bearing member for carrying and conveying the recording material onto which the toner (toner image) is transferred from the first image bearing member such as the photosensitive member. In some cases, on the recording material carrying member, fog toner deposits or a toner image for control is transferred, and therefore, a cleaning member contacting the recording material is provided in some instances. Further, the supplying operation similar to those in the above-described embodiments can be performed with respect to a cleaning position of the recording material carrying member. Further, a supplying operation for the purpose of supplying the toner to substantially only to the cleaning positions of the intermediary transfer member and the recording material carrying member can also be executed. In this case, the respective image forming portions function as a supplying means for supplying the toner to the intermediary transfer member and the recording material carrying member. Further, the present invention is also applicable to a single-color image forming apparatus including only one image forming portion. Also in this case, with respect to a cleaning position of a single image bearing member such as the photosensitive member, the supplying operation similar to those in the above-described embodiments.

Further, in the above-described embodiments, the toner band was formed through respective steps of the charging, the exposure and the development similarly as in the case of a normal image forming period, but in the supplying operation, the toner in a sufficient amount may only be supplied to the cleaning position. For example, an image forming process condition is changed and fog is positively generated on the photosensitive member, so that the toner can also be discharged from the developing device 4. That is, at least one of the charging voltage and the developing voltage is changed from the setting in the normal image forming period, so that an electric field for urging the toner from the photosensitive member toward the developer carrying member is weakened or an electric field for urging the toner from the developer carrying member toward the photosensitive member is generated. Such a state can be formed by making a potential difference between the dark portion potential of the photosensitive member (drum) and the DC component of the developing voltage smaller than that in the image forming period or by applying the developing voltage without charging the photosensitive member.

Further, in the above-described embodiments, the toner band was transferred from the photosensitive member onto the intermediary transfer member and the toner is supplied to the cleaning position of the intermediary transfer member, and the toner residual toner of the toner band is supplied to the cleaning position of the photosensitive member, but the present invention is not limited thereto. A part of the toner band (single toner band or a plurality of toner bands) formed at execution timing of a single supplying operation may be supplied to the cleaning position of the photosensitive member without being positively transferred onto the intermediary transfer member, and another part of the toner band may be positively transferred onto the intermediary transfer member and then may be supplied to the cleaning position of the intermediary transfer member.

Further, the photosensitive member is not limited to the drum-shaped photosensitive member (photosensitive drum), but may also be an endless belt-shaped photosensitive member (photosensitive member belt). Further, the intermediary transfer member and the recording material carrying member are not limited to those having the endless belt shape, but may also be those having a drum shape formed by stretching a film around a frame, for example. When the image forming apparatus is of an electrostatic recording type, the image bearing member is an electrostatic recording dielectric member formed in the drum shape or in the endless belt shape.

Further, the present invention particularly suitably acts in the case where the cleaning member is the blade-shaped member, but the cleaning member is not limited to the blade-shaped member. For example, a similar effect can be expected by applying the present invention to a member such as a block-shaped (pad-shaped) member or a sheet-shaped member when execution of the supplying operation for maintaining the sliding property with the image bearing member and for suppressing the paper powder deposition in the neighborhood of the contact position with the image bearing member is desired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-129625 filed on Jun. 30, 2017, which is hereby incorporated by reference herein in its entirety.

What is claimed is:

1. An image forming apparatus comprising:

a movable photosensitive member;

a toner image forming portion configured to form a toner image by depositing toner on an electrostatic image formed on said photosensitive member;

a movable intermediary transfer member having an endless shape;

an image transfer portion configured to primary-transfer the toner image from said photosensitive member onto said intermediary transfer member and then to secondary-transfer the toner image from said intermediary transfer member onto a recording material;

a cleaning blade contacting said intermediary transfer member at a contact portion, and configured to remove deposited matter on said intermediary transfer member with movement of said intermediary transfer member;

a job executing portion capable of executing a job which is started by a single start instruction and which is a series of operations in which images are formed and outputted on a single or a plurality of recording materials;

a toner supply executing portion capable of executing a supplying operation for supplying the toner to the contact portion by forming a supplying toner image on said photosensitive member and then by primary-transferring the supplying toner image from said photosensitive member onto said intermediary transfer member in a non-image-forming period which is other than a period in which the toner image to be secondary-transferred onto the recording material is formed on said photosensitive member;

a storing portion configured to store a first integrated value obtained by integrating a value corresponding to a distance of movement of said intermediary transfer member and a second integrated value obtained by integrating a number of images formed in the job or jobs; and a controller configured to cause said toner supply executing portion to execute the supplying operation and configured to set the first and second integrated values at initial values when the first integrated value reaches a first threshold or when the second integrated value reaches a second threshold, during execution of the job.

2. An image forming apparatus according to claim 1, wherein the distance of movement of said intermediary transfer member from a start to an end of a job in which a number of toner images is the second threshold is shorter than a distance corresponding to the first threshold.

3. An image forming apparatus according to claim 1, wherein the non-image-forming period is a period from formation of a final toner image on said photosensitive member in the job to a stop of said photosensitive member.

4. An image forming apparatus according to claim 1, wherein when the job is a job in which images are formed and outputted on a plurality of recording materials, the non-image-forming period is a period from formation of a certain toner image on said photosensitive member to formation of a subsequent toner image on said photosensitive member or a period from formation of a final toner image on said photosensitive member to a stop of said photosensitive member.

5. An image forming apparatus according to claim 1, wherein the supplying toner image is a band-like toner image extending in a direction perpendicular to a movement direction of said photosensitive member.

6. An image forming apparatus according to claim 1, wherein the supplying toner image has a density of a maximum density level.

7. An image forming apparatus according to claim 1, further comprising an input portion to which information on a kind of the recording material is inputted, wherein on the basis of the information inputted to said input portion, said controller changes whether the supplying operation is executed on the basis of both of the first and second thresholds or only the first threshold.

8. An image forming apparatus according to claim 1, further comprising an input portion to which information on a kind of the recording material is inputted, wherein said controller changes the second threshold on the basis of the information inputted to said input portion.

9. An image forming apparatus comprising:

a movable photosensitive member;

a toner image forming portion configured to form a toner image by depositing toner on an electrostatic image formed on said photosensitive member;

a first cleaning blade contacting said photosensitive member at a first portion and configured to remove deposited matter on said photosensitive member with movement of said photosensitive member;

a movable intermediary transfer member;

an image transfer portion configured to primary-transfer the toner image from said photosensitive member onto said intermediary transfer member and then to secondary-transfer the toner image from said intermediary transfer member onto a recording material;

a second cleaning blade contacting said intermediary transfer member at a second contact portion, and configured to remove deposited matter on said intermediary transfer member with movement of said intermediary transfer member;

a job executing portion capable of executing a job which is started by a single start instruction and which is a series of operations in which images are formed and outputted on a single or a plurality of recording materials;

a toner supply executing portion capable of executing a supplying operation for supplying the toner to the first and second contact portions by forming a supplying toner image on said photosensitive member and then by primary-transferring the supplying toner image from said photosensitive member onto said intermediary transfer member in a non-image-forming period which is other than a period in which the toner image to be secondary-transferred onto the recording material is formed on said photosensitive member;

a storing portion configured to store a first integrated value obtained by integrating a value corresponding to a distance of the movement of said photosensitive member and a second integrated value obtained by integrating a number of images formed in the job or jobs; and a controller configured to cause said toner supply executing portion to execute the supplying operation and configured to set the first and second integrated values at initial values when the first integrated value reaches a first threshold or when the second integrated value reaches a second threshold, during execution of the job.

10. An image forming apparatus according to claim 9, wherein the distance of movement of said photosensitive member from a start to an end of a job in which a number of toner images is the second threshold is shorter than a distance corresponding to the first threshold.

11. An image forming apparatus according to claim 9, wherein the non-image-forming period is a period from formation of a final toner image on said photosensitive member in the job to a stop of said photosensitive member.

12. An image forming apparatus according to claim 9, wherein when the job is a job in which images are formed and outputted on a plurality of recording materials, the non-image-forming period is a period from formation of a certain toner image on said photosensitive member to formation of a subsequent toner image on said photosensitive member or a period from formation of a final toner image on said photosensitive member to a stop of said photosensitive member.

13. An image forming apparatus according to claim 9, wherein the supplying toner image is a band-like toner image extending in a direction perpendicular to a movement direction of said photosensitive member.

14. An image forming apparatus according to claim 9, wherein the supplying toner image has a density of a maximum density level.

15. An image forming apparatus according to claim 9, further comprising an input portion to which information on a kind of the recording material is inputted, wherein on the basis of the information inputted to said input portion, said controller changes whether the supplying operation is executed on the basis of both of the first and second thresholds or only the first threshold.

16. An image forming apparatus according to claim 9, further comprising an input portion to which information on a kind of the recording material is inputted, wherein said controller changes the second threshold on the basis of the information inputted to said input portion.

17. An image forming apparatus according to claim 9, further comprising a plurality of toner image forming stations each including said photosensitive member, said toner image forming portion and said first cleaning blade, wherein said controller causes said toner supply executing portion to execute the supplying operation and sets the first and second integrated values at initial values when the first integrated value in at least one of said toner image forming stations reaches the first threshold or when the second integrated value in at least one of said toner image forming stations reaches the second threshold.

* * * * *